US010487535B2

(12) United States Patent
Knudsen

(10) Patent No.: US 10,487,535 B2
(45) Date of Patent: Nov. 26, 2019

(54) FENCE PANEL SYSTEMS AND METHODS

(71) Applicant: N. Eric Knudsen, Maple Valley, WA (US)

(72) Inventor: N. Eric Knudsen, Maple Valley, WA (US)

( * ) Notice: Subject to any disclaimer, the term of this patent is extended or adjusted under 35 U.S.C. 154(b) by 309 days.

(21) Appl. No.: 15/331,493

(22) Filed: Oct. 21, 2016

(65) Prior Publication Data

US 2017/0138086 A1 May 18, 2017

Related U.S. Application Data

(62) Division of application No. 14/705,906, filed on May 6, 2015, now Pat. No. 9,506,270.

(60) Provisional application No. 62/037,544, filed on Aug. 14, 2014.

(51) Int. Cl.

| | |
|---|---|
| ***E04H 17/16*** | (2006.01) |
| ***E04H 17/22*** | (2006.01) |
| *E04H 17/14* | (2006.01) |

(52) U.S. Cl.

CPC ..... *E04H 17/166* (2013.01); *E04H 17/165* (2013.01); *E04H 17/168* (2013.01); *E04H 17/22* (2013.01); *E04H 2017/1456* (2013.01)

(58) Field of Classification Search

CPC ..... E04H 17/16; E04H 17/163; E04H 17/165; E04H 17/166; E04H 17/168; E04H 17/14; E04H 17/1404; E04H 17/1413; E04H 17/1417; E04H 17/1426; E04H 17/143; E04H 2017/1447; E04H 2017/1452; E04H 2017/1456

See application file for complete search history.

(56) References Cited

U.S. PATENT DOCUMENTS

| | | | |
|---|---|---|---|
| 3,454,262 | A | 7/1969 | Romano |
| 5,078,367 | A | 1/1992 | Simpson et al. |
| D427,322 | S | 6/2000 | DeSouza |
| 6,398,193 | B1 | 6/2002 | DeSouza |
| D463,036 | S | 9/2002 | Petitt et al. |
| 6,478,287 | B2 | 11/2002 | DeSouza |
| 6,913,249 | B1 | 7/2005 | Lerdu |
| 7,040,605 | B2 | 5/2006 | Lappen |
| 7,111,828 | B2 | 9/2006 | Rosine et al. |
| D549,468 | S | 8/2007 | Dressendorfer et al. |
| D608,056 | S | 1/2010 | Evans |
| 7,861,434 | B2 | 1/2011 | Knudsen |
| D638,955 | S | 5/2011 | Kopp et al. |
| 7,934,699 | B2 | 5/2011 | Zell et al. |
| 8,046,965 | B2 | 11/2011 | Rieber et al. |
| D665,098 | S | 8/2012 | Kopp et al. |

(Continued)

FOREIGN PATENT DOCUMENTS

| | | |
|---|---|---|
| DE | 10 2007 023 501 A1 | 11/2008 |
| DE | 20 2012 012 273 U1 | 4/2013 |

(Continued)

*Primary Examiner* — Matthieu F Setliff

(74) *Attorney, Agent, or Firm* — Seed Intellectual Property Law Group LLP

(57) ABSTRACT

A fence panel can include a plurality of modular fence panel components that can be assembled modularly to form the fence panel. The fence panel components can include a system of keys and keyways that allow the components to interlock with one another when the fence panel is assembled to lock the components to one another to simplify the assembly process and to minimize the number of mechanical fasteners needed to assemble the fence panel.

10 Claims, 14 Drawing Sheets

(56) References Cited

U.S. PATENT DOCUMENTS

| | | | |
|---|---|---|---|
| D675,341 | S | 1/2013 | Cochrane |
| 8,511,648 | B2 | 8/2013 | McCarthy et al. |
| D697,230 | S | 1/2014 | Esposito |
| D713,546 | S | 9/2014 | Murray |
| D717,471 | S | 11/2014 | Donnelly et al. |
| 9,149,894 | B2 | 10/2015 | Richison et al. |
| 2002/0011594 | A1 | 1/2002 | DeSouza |
| 2002/0020834 | A1 | 2/2002 | Stusser |
| 2004/0140461 | A1 | 7/2004 | Lappen |
| 2004/0140464 | A1 | 7/2004 | Lappen |
| 2004/0206946 | A1 | 10/2004 | Lappen |
| 2004/0206948 | A1 | 10/2004 | Lappen |
| 2006/0113517 | A1 | 6/2006 | Colantonio et al. |
| 2007/0209318 | A1 | 9/2007 | McCarthy |
| 2007/0224885 | A1 | 9/2007 | McCarthy |
| 2007/0251179 | A1 | 11/2007 | McCarthy |
| 2007/0278468 | A1 | 12/2007 | Zacarias et al. |
| 2008/0179580 | A1 | 7/2008 | McGinness et al. |
| 2009/0078923 | A1 | 3/2009 | McGinness et al. |
| 2009/0152523 | A1 | 6/2009 | Erwin |
| 2009/0282770 | A1 | 11/2009 | Rieber et al. |
| 2010/0096608 | A1 | 4/2010 | McCarthy et al. |
| 2010/0200825 | A1 | 8/2010 | Hill |
| 2011/0233496 | A1 | 9/2011 | Caruso |
| 2013/0153843 | A1 | 6/2013 | Leach |
| 2013/0320281 | A1 | 12/2013 | Richison et al. |
| 2013/0328001 | A1 | 12/2013 | McCarthy et al. |
| 2015/0041743 | A1 | 2/2015 | Richison et al. |

FOREIGN PATENT DOCUMENTS

| | | | |
|---|---|---|---|
| FR | 1572217 | A | 6/1969 |
| FR | 2 887 911 | B1 | 12/2008 |
| FR | 2 983 895 | A1 | 6/2013 |
| JP | D1060445 | S | 2/2000 |
| JP | D1060447 | S | 2/2000 |
| JP | D1060449 | S | 2/2000 |
| JP | D1060450 | S | 2/2000 |

FENCE PANEL SYSTEMS AND METHODS

CROSS REFERENCE TO RELATED APPLICATIONS

This application is a divisional application of U.S. patent application Ser. No. 14/705,906, filed May 6, 2015, which is a non-provisional application of U.S. Provisional Patent Application No. 62/037,544, filed Aug. 14, 2014, both of which are hereby incorporated herein by reference in their entireties.

BACKGROUND

Technical Field

The present disclosure relates to fences, fence panels, modular components for forming fence panels, and related methods of forming fence panels.

Description of the Related Art

Fences are available in a variety of designs. In some cases, a fence can include fence posts and fence panels supported by and spanning between adjacent fence posts. Some fence panels are opaque structures, while others include lattice components for aesthetic or functional purposes. Some fence panels can be assembled on-site at an installation location, while others can be pre-fabricated and transported to an installation location. Many currently available fence panels are time consuming and expensive to construct, or are too large to easily transport.

BRIEF SUMMARY

In some embodiments, a fence panel kit for constructing a fence panel to be installed between adjacent fence posts comprises: one or more packaged arrangements of fence panel components including a base element, a center rail, a top rail, a first side element, a second side element, a plurality of interior sub-panel assemblies each including a plurality of fence boards, and at least one lattice component, the base element, the center rail, the top rail, the lattice divider, the first side element, the second side element, each of the plurality of interior sub-panel assemblies, and the at least one lattice component being disconnected from one another for storage and transport in the one or more packaged arrangements, and wherein the base element, the center rail, the top rail, the first side element, the second side element, each of the plurality of interior sub-panel assemblies, and the at least one lattice component include interlocking features to assist in joining the fence panel components together to form the fence panel.

In some cases, the base element includes a bottom rail coupled to a bottom supporting element. In some cases, the plurality of fence boards of each of the interior sub-panel assemblies is at least partially bordered by a plurality of perimeter components. In some cases, the perimeter components include interlocking features to interlock with adjoining components. In some cases, the perimeter components of one or more of the interior sub-panel assemblies comprises a joint member that is configured to insertably receive a portion of an adjacent one of the interior sub-panel assemblies when the fence panel is constructed. In some cases, the base element, the center rail, the top rail, the first side element, the second side element, the plurality of interior sub-panel assemblies and a lattice divider are packaged in a first packaged arrangement, and a plurality of lattice components are packaged in a second packaged arrangement separate from the first packaged arrangement.

In some cases, the lattice components are first lattice elements having a first latticework pattern, and the fence panel kit further comprises a third packaged arrangement of fence panel components including a plurality of second lattice elements disconnected from one another for storage and transport in the third packaged arrangement, and the plurality of second lattice elements have a second latticework pattern different from the first latticework pattern. In some cases, the second and the third packaged arrangements of fence panel components are alternatively combinable with the first packaged arrangement of fence panel components to form a complete fence panel with different lattice structures. In some cases, the base element includes a base male-female mating feature and each of the plurality of interior sub-panel assemblies includes a male-female mating feature matching the base male-female mating feature.

In some cases, the first side element includes a first side male-female mating feature and the second side element includes a second side male-female mating feature, the plurality of interior sub-panel assemblies includes a first end interior sub-panel assembly and a second end interior sub-panel assembly, the first end interior sub-panel assembly includes a first end male-female mating feature matching the first side male-female mating feature, and the second end interior sub-panel assembly includes a second end male-female mating feature matching the second side male-female mating feature.

In some cases, the first end interior sub-panel assembly includes an interior facing male-female mating feature and the second end interior sub-panel assembly includes an interior facing male-female mating feature matching the interior facing male-female mating feature such that one or more additional interior sub-panel assemblies with similar interlocking features can be received between the first end interior sub-panel assembly and the second end interior sub-panel assembly. In some cases, the fence panel components include at least four separate interior sub-panel assemblies arranged in a stack of interior sub-panel assemblies, and the base element, the center rail, the top rail, a lattice divider, the first side element, and the second side element are positioned adjacent the stack.

In some embodiments, a method to facilitate construction of a fence comprising a plurality of fence panels supported by fence posts comprises: providing one or more packaged arrangements of fence panel components including a base element, a center rail, a top rail, a lattice divider, a first side element, a second side element, a plurality of interior sub-panel assemblies, and a plurality of lattice components, the base element, the center rail, the top rail, the lattice divider, the first side element, the second side element, each of the plurality of interior sub-panel assemblies, and each of the plurality of lattice components being disconnected from one another for storage and transport in the one or more packaged arrangements, and wherein the base element, the center rail, the top rail, the lattice divider, the first side element, the second side element, each of the plurality of interior sub-panel assemblies, and each of the plurality of lattice components include interlocking features to assist in joining the fence panel components together to form the fence panel.

In some cases, the method further comprises packaging the base element, the center rail, the top rail, the lattice divider, the first side element, the second side element, and the plurality of interior sub-panel assemblies in a first packaged arrangement and packaging the plurality of lattice components in a second packaged arrangement separate from the first packaged arrangement. In some cases, the method further comprises shipping the separated first packaged arrangement and the second packaged arrangement to a remote location for storage or use in constructing the fence panel.

In some embodiments, a method of constructing a fence panel comprises: assembling a fence panel from one or more packaged arrangements of fence panel components, the fence panel components of the fence panel including a plurality of interior sub-panel assemblies, a first side element, a second side element, a center rail, a bottom rail, a top rail, a lattice divider, and a plurality of lattice components, and the assembly of the fence panel comprising, joining the plurality of interior sub-panel assemblies together laterally between the first and second side elements and longitudinally between the center rail and the bottom rail to form a panel main body, and joining the plurality of lattice components to the panel main body.

In some cases, joining the plurality of interior sub-panel assemblies together laterally between the first and second side elements and longitudinally between the center rail and the bottom rail to form the panel main body includes fitting a male-female mating feature of a first interior sub-panel assembly into a male-female mating feature of a second interior sub-panel assembly. In some cases, joining the plurality of interior sub-panel assemblies together laterally between the first and second side elements and longitudinally between the center rail and the bottom rail to form a panel main body comprises: coupling a first end interior sub-panel assembly to the first side element and to the bottom rail, coupling one or more intermediate interior sub-panel assemblies to the first end interior sub-panel assembly and the bottom rail, coupling a second end interior sub-panel assembly to the one or more intermediate interior sub-panel assemblies and to the bottom rail, and coupling the second side element to the second end interior sub-panel assembly.

In some cases, joining the plurality of lattice components to the panel main body comprises: coupling a first lattice structure to the first side element, coupling a second lattice structure to the second side element, and coupling the lattice divider between the first lattice structure and the second lattice structure. In some cases, coupling the first end interior sub-panel assembly to the first side element and to the bottom rail comprises coupling a first end male-female mating feature of the first end interior sub-panel assembly to a male-female mating feature of the first side element and a bottom male-female mating feature of the first end interior sub-panel assembly to a male-female mating feature of the bottom rail. In some cases, coupling the one or more intermediate interior sub-panel assemblies to the first end interior sub-panel assembly and the bottom rail comprises coupling a plurality of interior sub-panel assemblies together in a side-by-side arrangement.

In some cases, coupling the second end interior sub-panel assembly to the one or more intermediate interior sub-panel assemblies and to the bottom rail comprises coupling a first end male-female mating feature of the second end interior sub-panel assembly to a male-female mating feature of the one or more intermediate interior sub-panel assemblies and a bottom male-female mating feature of the second interior sub-panel assembly to a male-female mating feature of the bottom rail. In some cases, coupling the second side element to the second end interior sub-panel assembly comprises coupling a male-female mating feature of the second end interior sub-panel assembly to a corresponding male-female mating feature of the second side element.

In some cases, joining the plurality of interior sub-panel assemblies and joining the plurality of lattice components includes: joining the top rail to the first side element, joining a first lattice component to the top rail and to the first side element, joining the lattice divider to the top rail and to the first lattice component, joining a second lattice component to the top rail and to the lattice divider, joining the center rail to the first side element, the first lattice component, the lattice divider, and the second lattice component, joining a first interior sub-panel assembly to the first side element and to the center rail, joining a second interior sub-panel assembly to the center rail and indirectly to the first interior sub-panel assembly, joining the second side element to the top rail, to the second lattice component, to the center rail, and to the second interior sub-panel assembly, and joining the bottom rail to the first interior sub-panel assembly, to the second interior sub-panel assembly, to the first side element, and to the second side element.

In some cases, joining the plurality of interior sub-panel assemblies and joining the plurality of lattice components includes: joining the bottom rail to the first side element, joining a first interior sub-panel assembly to the bottom rail and to the first side element, joining a second interior sub-panel assembly to the bottom rail and indirectly to the first interior sub-panel assembly, joining the center rail to the first side element, the first interior sub-panel assembly, and to the second interior sub-panel assembly, joining the second side element to the bottom rail, to the second interior sub-panel assembly, and to the center rail, joining a first lattice component to the first side element and to the center rail, joining the lattice divider to the center rail and to the first lattice component, joining a second lattice component to the lattice divider, to the center rail, and to the second side element, and joining the top rail to the first side element, to the first lattice component, to the lattice divider, to the second lattice component, and to the second side element.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures, features, devices and techniques associated with fences and fence constructing have not been shown or described in detail to avoid unnecessarily obscuring descriptions of the embodiments. For example, although not illustrated in the Figures, it will be appreciated that embodiments of the fence panels described herein may be constructed with conventional fasteners, such as nails and/or screws, of suitable size and quantity to form a rigid fence structure. In addition, although example embodiments shown in the Figures are illustrated as wood fence panels, it is appreciated that fence panels may be formed of other materials, such as metal or vinyl, and that aspects of the embodiments described herein may be modified accordingly.

Figure 1:
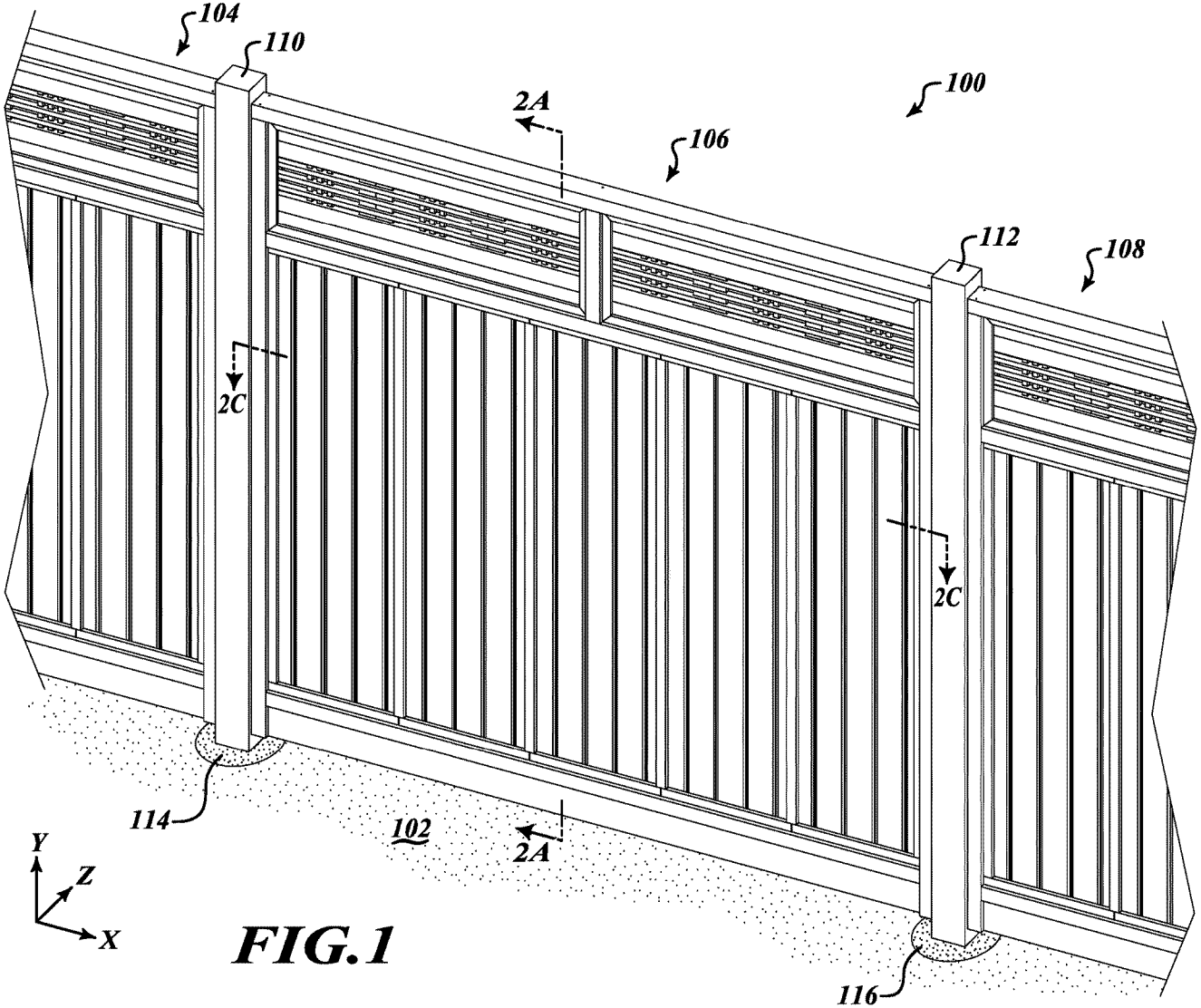
FIG. 1 is an isometric view of a portion of a fence, according to one example embodiment, including a plurality of fence panels positioned between respective pairs of posts.

FIG. 1 illustrates a portion of a fence 100 and more particularly a portion of a wood fence. Fence 100 is a completed, assembled fence built to stand in and rise vertically from the ground 102. In different embodiments, the fence 100 can be built in various environments and the ground 102 can include different types of earth, dirt, soil, rock, etc. In some embodiments, the fence 100 may be supported above the ground 102, such as, for example, by fence post supports extending above the ground 102. Fence 100 includes a first fence panel 104, a second fence panel 106, and a third fence panel 108 all of similar construction. Fence 100 also includes a first fence post 110 and a second fence post 112. The fence posts 110, 112 are positioned and supported within respective post holes 114, 116 formed in the ground 102. The first fence panel 104 is supported at one end by the first fence post 110, the second fence panel 106 is supported by and spans between the first fence post 110 and the second fence post 112, and the third fence panel 108 is supported at one end by the second fence post 112. The fence panels 104, 106, and 108 can be coupled to the fence posts 110, 112 using nails, screws, bolts, or other mechanical fasteners.

The second fence panel 106 has a length extending from a first end of the second fence panel 106 (which is fixed to the first fence post 110) to a second end of the second fence panel 106 (which is fixed to the second fence post 112) along a first dimension X, which can be horizontal and aligned with the direction in which the fence 100 runs. The second fence panel 106 also has a height extending from a top of the second fence panel 106 to a bottom of the second fence panel 106 along a second dimension Y, which can be vertical and perpendicular to the first dimension X. The second fence panel 106 also has a width extending from a first major surface or side of the second fence panel 106 visible in FIG. 1 (e.g., a "front" of the fence panel 106) to a second major surface or side of the second fence panel 106 not visible in FIG. 1 (e.g., a "back" or "rear" of the fence panel 106) along a third dimension Z, which can be horizontal and perpendicular to the first dimension X and the second dimension Y. Fence panels can have various dimensions, such as a length of 6 feet or 8 feet, a height of 3, 3.5, 4.0, 4.5, 5.75, or 6 feet, and a width of 0.625, 1.5, 2.5, or 3.5 inches.

Figure 2:
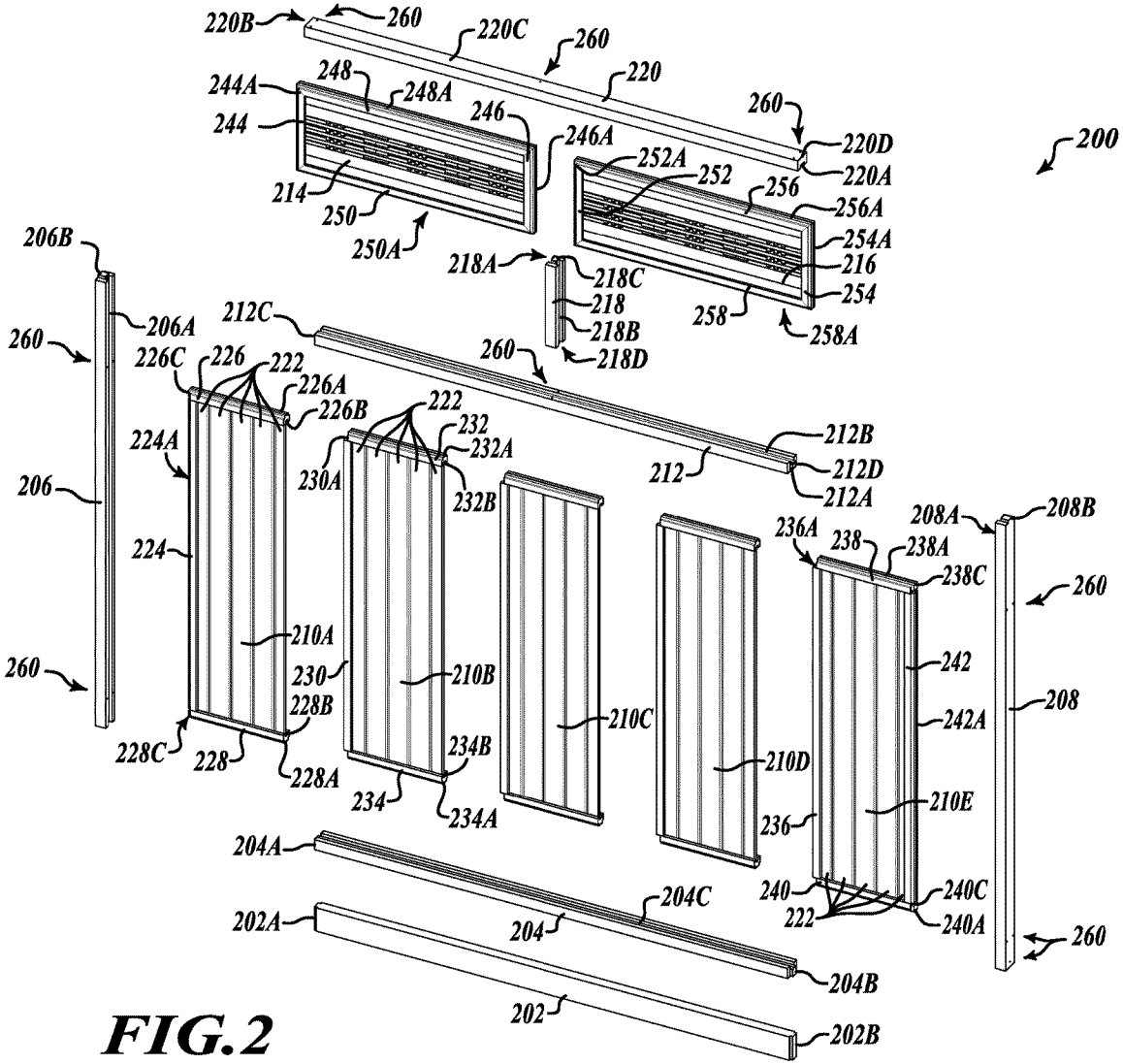
FIG. 2 is an isometric exploded view of a fence panel of the fence of FIG. 1 which illustrates a plurality of fence panel components thereof.

FIG. 2 illustrates various components of a modular fence panel 200 that can be used to form the fence panels 104, 106, and 108 of the fence 100 shown in FIG. 1. Fence panel 200 includes a horizontal base element or bottom supporting element 202, a bottom rail 204, a vertical first side element or column or post 206, a vertical second side element or column or post 208, a first end interior sub-panel assembly 210A, three central interior sub-panel assemblies 210B, 210C, 210D, a second end interior sub-panel assembly 210E, a horizontal intermediate or center crossbar or rail 212, two lattice components 214, 216, a vertical lattice divider post 218, and an upper or top crossbar or rail 220. The first end interior sub-panel assembly 210A, three central interior sub-panel assemblies 210B, 210C, 210D, and second end interior sub-panel assembly 210E can be referred to collectively as interior sub-panel assemblies 210. The lattice components 214, 216 can each have a first latticework pattern. Although the two lattice components 214, 216 are shown as two separate lattice assemblies separated by the divider post 218, it is appreciated that a single latticework assembly may be provided without the divider post 218.

The fence panel 200 can be assembled or constructed from its various components or modules, and thus can be referred to as a modular fence panel 200 which can be fabricated, shipped, and assembled modularly and can make use of fence panel construction techniques. Thus, individual components of the fence panel 200 can be interchanged or replaced with alternative components as desired, without the need to fabricate or obtain any additional components. To facilitate this aspect of the modular nature of the fence panel 200, each of the components of the fence panel 200 can be provided with complementary and interchangeable coupling elements, as described further below. Each of the components of the fence panel 200 can have a first end (or edge), second end (or edge), top end (or edge), bottom end (or edge), first side, and second side, consistent with the use of those terms above with respect to FIG. 1, fence panel 106, and the dimensions X, Y, and Z.

With continued reference to FIG. 2, the horizontal base element 202 includes a first end having a vertical key 202A protruding therefrom and a second end having another vertical key 202B protruding therefrom. The bottom rail 204 includes a first end having a vertical key 204A protruding therefrom and a second end having another vertical key 204B protruding therefrom. The top of the bottom rail 204 includes a keyway 204C extending along the length of the bottom rail 204. The bottom rail 204 can be wider than the base element 202 and the bottom rail 204 and base element 202 can be coupled to one another to form an elongate bottom crossbar having a generally T-shaped cross-sectional profile. The bottom rail 204 can be coupled to the base element 202 using various adhesives or mechanical fasteners. The elongate bottom crossbar may be pre-assembled or coupled together prior to receipt by an end-user. Although a two-piece bottom crossbar is shown, a single, unitary bottom crossbar having the same or different cross-sectional profile may be provided in some embodiments. The first end vertical key 202A can have dimensions matching those of the first end vertical key 204A, and the second end vertical key 202B can have dimensions matching those of the second end vertical key 204B, such that when the bottom rail 204 is coupled to the base element 202, the first end vertical keys 202A, 204A have matching profiles and form a single vertical key that can engage with a corresponding keyway and the second end vertical keys 202B, 204B have matching profiles and form a single vertical key that can engage with a corresponding keyway.

With continued reference to FIG. 2, the first side element or post 206 includes a first end having a planar face or surface such that it can bear against and be secured to a fence post, such as the fence posts 110, 112 shown in FIG. 1, and a second end having a vertical keyway 206A formed therein for receiving a complementary key (e.g., a key having a matching profile). The first side element or post 206 also includes a top end having a horizontal key 206B formed therein for engaging with a complementary keyway. The second side element or post 208 includes a first end having a vertical keyway 208A formed therein for receiving a complementary key and a second end having a planar face or surface such that it can bear against and be secured to a fence post, such as the fence posts 110, 112 shown in FIG. 1. The second side element or post 208 also includes a top end having a horizontal key 208B formed therein for engaging with a complementary keyway.

The first end interior sub-panel assembly 210A includes a plurality of fence boards 222 interlocked together and partially bordered by a first end perimeter component 224, a top perimeter component 226, and a bottom perimeter component 228. The first end interior sub-panel assembly 210A of the illustrated embodiment includes five fence boards 222, including partial fence boards, that are interlocked together, however, it is appreciated that in other instances more or fewer fence boards 222 may be provided and the fence boards 222 may abut each other or may be spaced apart. The first end perimeter component 224 includes a first end having a first end vertical key 224A formed therein for engaging with a complementary keyway. The vertical key 224A can be complementary with and thus can engage the keyway 206A. The top perimeter component 226 includes a top end having a horizontal key 226A formed therein for engaging with a complementary keyway. The bottom perimeter component 228 includes a bottom end having a horizontal key 228A formed therein for engaging with a complementary keyway. The horizontal key 228A can be complementary with and thus can engage the keyway 204C.

Figure 2B:
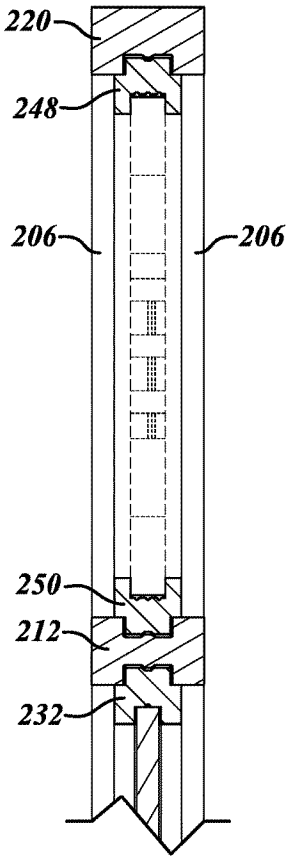
FIG. 2B is an enlarged detail view of a portion of the cross-sectional view of FIG. 2A.
Figure 2A:
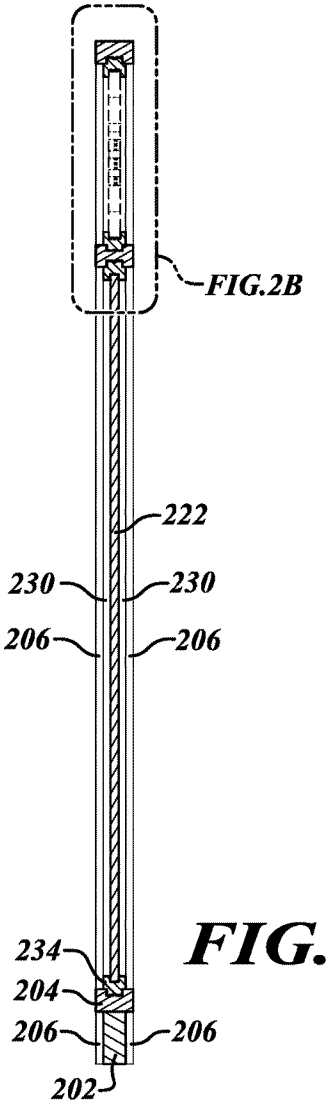
FIG. 2A is a cross-sectional view of a fence panel of the fence of FIG. 1 taken along line 2A-2A.
Figure 2C:
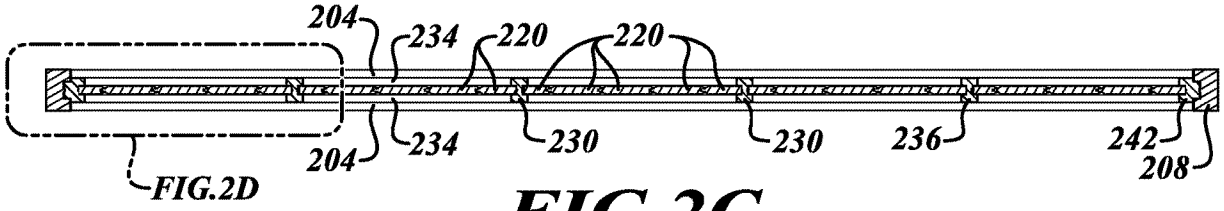
FIG. 2C is a cross-sectional view of the fence panel of the fence of FIG. 1 taken along line 2C-2C.
Figure 2D:
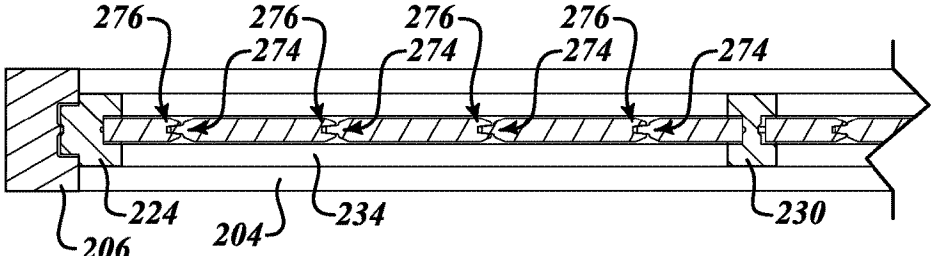
FIG. 2D is an enlarged detail view of a portion of the cross-sectional view of FIG. 2C.

The first end perimeter component 224 also includes a second end having a vertical keyway (not illustrated in FIG. 2) complementary to a first end of one of the fence boards 222 such that the first end of the fence board can engage with the first end perimeter component 224, as shown best in FIG. 2D. The top perimeter component 226 similarly includes a bottom end having a horizontal keyway 226B complementary to top ends of the fence boards 222 such that the top ends of the fence boards 222 can engage with the top perimeter component 226. The bottom perimeter component 228 similarly includes a top end having a horizontal keyway 228B complementary to bottom ends of the fence boards 222 such that the bottom ends of the fence boards 222 can engage with the bottom perimeter component 228.

The top perimeter component 226 also includes a first end vertical key 226C and the bottom perimeter component 228 also includes a first end vertical key 228C. The vertical keys 226C, 228C can both have profiles matching the first end vertical key 224A such that these three vertical keys can together form a single vertical key of the first end interior sub-panel assembly 210A that can engage with the keyway 206A. In one alternative embodiment, the first end of the top perimeter component 226 can be cut flush and have a planar surface instead of the key 226C, and the first end of the bottom perimeter component 228 can be cut flush and have a planar surface instead of the key 228C. The top perimeter component 226 and the bottom perimeter component 228 each extend in the direction of the second end interior sub-panel assembly 210E a distance beyond the fence boards 222, to accommodate a first end perimeter component of the central interior sub-panel assembly 2106, as described in greater detail below.

With continued reference to FIG. 2, each of the central interior sub-panel assemblies 210B, 210C, and 210D can have the same structure to each other. Central interior sub-panel assembly 210B is described in detail herein and can be considered as representative of the other central interior sub-panel assemblies 210C, 210D. Central interior sub-panel assembly 210B includes a plurality of fence boards 222 interlocked together and partially bordered by a first end perimeter component 230, a top perimeter component 232, and a bottom perimeter component 234. The central interior sub-panel assembly 2106 of the illustrated embodiment includes five fence boards 222, including partial fence boards, that are interlocked together, however, it is appreciated that in other instances more or fewer fence boards 222 may be provided and the fence boards 222 may abut each other or may be spaced apart. The first end perimeter component 230 includes a first end having a vertical keyway 230A complementary to a second end of one of the fence boards 222 (e.g., one of the fence boards 222 of the first end sub-panel assembly 210A) such that the second end of the fence board 222 can engage with the first end perimeter component 230, as shown best in FIG. 2D. The top perimeter component 232 includes a top end having a horizontal key 232A formed therein for engaging with a complementary keyway. The bottom perimeter component 234 includes a bottom end having a horizontal key 234A formed therein for engaging with a complementary keyway. The horizontal key 234A can be complementary with and thus can engage the keyway 204C.

The first end perimeter component 230 of the central interior sub-panel assembly 210B also includes a second end having a vertical keyway (not illustrated in FIG. 2) complementary to a first end of one of the fence boards 222 such that the first end of the fence board 222 can engage with the first end perimeter component 230, as shown best in FIG. 2D. The top perimeter component 232 also includes a bottom end having a horizontal keyway 232B complementary to top ends of the fence boards 222 such that the top ends of the fence boards 222 can engage with the top perimeter component 232. The bottom perimeter component 234 also includes a top end having a horizontal keyway 234B complementary to bottom ends of the fence boards 222 such that the bottom ends of the fence boards 222 can engage with the bottom perimeter component 234.

As noted above, the top perimeter component 226 and the bottom perimeter component 228 each extend in the direction of the second end interior sub-panel assembly 210E a distance beyond the fence boards 222, to accommodate the first end perimeter component 230 of the central interior sub-panel assembly 2106 and so that the second ends of the top perimeter component 226 and the bottom perimeter component 228 center on the first end perimeter component 230 of the central interior sub-panel assembly 210B. Similarly, the top perimeter component 232 and the bottom perimeter component 234 of the central interior sub-panel assembly 2106 each extend in the direction of the second end interior sub-panel assembly 210E a distance beyond the fence boards 222 of the assembly 2106, to accommodate a first end perimeter component of the central interior sub-panel assembly 210C.

The top perimeter component 232 and the bottom perimeter component 234 of the central interior sub-panel assembly 210B each extend in the direction of the first end interior sub-panel assembly 210A a distance short of the vertical keyway 230A of the first end perimeter component 230, so that a fence board 222 of the assembly 210A can be received in the vertical keyway 230A of the first end perimeter component 230 of the central interior sub-panel assembly 2106 such that the second end of the top perimeter component 226 is generally flush with the first end of the top perimeter component 232 and the second end of the bottom perimeter component 228 is generally flush with the first end of the bottom perimeter component 234.

As noted above, central interior sub-panel assemblies 210C and 210D can have the same form or structure as the assembly 2106. Thus, the first end perimeter component of the assembly 210C can engage with a fence board 222 at the second end of the assembly 210B and the first end perimeter component of the assembly 210D can engage with a fence board 222 at the second end of the assembly 210C.

The second end interior sub-panel assembly 210E includes a plurality of fence boards 222 interlocked together and partially bordered by a first end perimeter component 236, a top perimeter component 238, a bottom perimeter component 240, and a second end perimeter component 242. The second end interior sub-panel assembly 210E of the illustrated embodiment includes five fence boards 222, including partial fence boards, that are interlocked together, however, it is appreciated that in other instances more or fewer fence boards 222 may be provided and the fence boards 222 may abut each other or may be spaced apart. The second end perimeter component 242 includes a second end having a second end vertical key 242A formed therein for engaging with a complementary keyway. The vertical key 242A can be complementary with and thus can engage the keyway 208A. The top perimeter component 238 includes a top end having a horizontal key 238A formed therein for engaging with a complementary keyway. The bottom perimeter component 240 includes a bottom end having a horizontal key 240A formed therein for engaging with a complementary keyway. The horizontal key 240A can be complementary with and thus can engage the keyway 204C. The keys 228A, 234A, 240A of the interior sub-panel assemblies 210A-210E have matching profiles and can form a single horizontal key that is complementary to and thus can engage with the keyway 204C of the bottom rail 204. Although a single horizontal key may be provided, it is also appreciated that in other instances key portions may be intermittently spaced to collectively from the horizontal key.

The second end perimeter component 242 also includes a first end having a vertical keyway (not illustrated in FIG. 2) complementary to a second end of one of the fence boards 222 such that the second end of the fence board 222 can engage with the second end perimeter component 242. The top perimeter component 238 similarly includes a bottom end having a horizontal keyway (not illustrated in FIG. 2) complementary to top ends of the fence boards 222 such that the top ends of the fence boards 222 can engage with the top perimeter component 238. The bottom perimeter component 240 similarly includes a top end having a horizontal keyway (not illustrated in FIG. 2) complementary to bottom ends of the fence boards 222 such that the bottom ends of the fence boards 222 can engage with the bottom perimeter component 240.

The top perimeter component 238 also includes a second end vertical key 238C and the bottom perimeter component 240 also includes a second end vertical key 240C. The vertical keys 238C, 240C can both have profiles matching the second end vertical key 242A such that these three vertical keys can together form a single vertical key of the second end interior sub-panel assembly 210E that can engage with the keyway 208A. In one alternative embodiment, the second end of the top perimeter component 238 can be cut flush and have a planar surface instead of the key 238C, and the second end of the bottom perimeter component 240 can be cut flush and have a planar surface instead of the key 240C.

The first end perimeter component 236 includes a first end having a vertical keyway 236A complementary to a second end of one of the fence boards 222 (e.g., one of the fence boards 222 of the central interior sub-panel assembly 210D) such that the second end of the fence board 222 can engage with the first end perimeter component 236. The first end perimeter component 230 also includes a second end having a vertical keyway (not illustrated in FIG. 2) complementary to a first end of one of the fence boards 222 such that the first end of the fence board 222 can engage with the first end perimeter component 236.

The top perimeter component 238 and the bottom perimeter component 240 of the second end interior sub-panel assembly 210E each extend in the direction of the first end interior sub-panel assembly 210A a distance short of the vertical keyway 236A of the first end perimeter component 236, so that a fence board 222 of the assembly 210D can be received in the vertical keyway 236A of the first end perimeter component 236 of the central interior sub-panel assembly 210E such that the second end of the top perimeter component of the assembly 210D is generally flush with the first end of the top perimeter component 238 and the second end of the bottom perimeter component of the assembly 210D is generally flush with the first end of the bottom perimeter component 240.

With continued reference to FIG. 2, the center rail 212 includes a bottom end or bottom face having a bottom horizontal keyway 212A formed therein and a top end or top face having a top horizontal keyway 212B formed therein. The horizontal keys 226A, 232A, 238A can have matching profiles and can form a single horizontal key or intermittent key portions that is/are complementary to and thus can engage with the keyway 212A. The center rail 212 also includes a first end having a first end key 212C formed therein and a second end having a second end key 212D formed therein.

The vertical lattice divider post 218 includes a first end or face having a first end keyway 218A formed therein, a second end or face having a second end keyway 2186 formed therein, a top end or face having a top key 218C formed therein, and a bottom end or face having a bottom key 218D formed therein. The bottom key 218D can be complementary to and thus can engage with the top horizontal keyway 212B of the center rail 212.

The top rail 220 includes a bottom end having a bottom keyway 220A formed therein, a first end having a first end planar surface 220B, a top end having a top planar surface 220C, and a second end having a second end planar surface 220D. When the fence panel 200 is assembled, the first end planar surface 220B can be generally flush with the planar surface of the first end of the first side element or post 206 to form a flat surface that can bear against a fence post, such as the fence posts 110, 112 shown in FIG. 1, and the second end planar surface 220D can be generally flush with the planar surface of the second end of the second side element or post 208 to form a flat surface that can bear against a fence post, such as the fence posts 110, 112 shown in FIG. 1.

The first lattice component 214 includes a first end perimeter element 244 having a first end key 244A formed therein, a second end perimeter element 246 having a second end key 246A formed therein, a top end perimeter element 248 having a top key 248A formed therein, a bottom end perimeter element 250 having a bottom key 250A formed therein, and latticework extending between the first end, second end, top, and bottom elements 244, 246, 248, and 250. Similarly, the second lattice component 216 includes a first end perimeter element 252 having a first end key 252A formed therein, a second end perimeter element 254 having a second end key 254A formed therein, a top end perimeter element 256 having a top key 256A formed therein, a bottom end perimeter element 258 having a bottom key 258A formed therein, and latticework extending between the first end, second end, top, and bottom elements 252, 254, 256, 258.

The keys 250A, 218D, 258A have matching profiles and can form a single horizontal key or intermittent key portions that is/are complementary to and thus can engage with the keyway 212B of the center rail 212. The second end key 246A of the first lattice component 214 can be complementary to the first end keyway 218A of the divider post 218 and the first end key 252A of the second lattice component 216 can be complementary to the second end keyway 218B of the divider post 218. The keys 248A, 218C, 256A have matching profiles that also match the profiles of the key 206B of the first side element or post 206 and the key 208B of the second side element or post 208, such that the keys 248A, 218C, 256A, 206B, and 208B can form a single horizontal key or intermittent key portions that is/are complementary to and thus can engage with the keyway 220A of the top rail 220.

The keys 202A, 204A, 228C, 224A, 226C, 212C, 244A have matching profiles and can form a single vertical key or intermittent key portions that is/are complementary to and thus can engage with the keyway 206A of the first side element or post 206. The keys 202B, 204B, 240C, 242A, 238C, 212D, and 254A have matching profiles and can form a single vertical key or intermittent key portions that is/are complementary to and thus can engage with the keyway 208A of the second side element or post 208.

In some embodiments, fence posts such as fence posts 110 and 112 can be provided with keys and keyways to engage with respective keys and keyways of the components of a fence panel such as fence panel 200. In such embodiments, the fence panel can be provided without side elements or posts such as side elements or posts 206 and 208, and the sub-panel assemblies 210 can be coupled directly to the fence posts 110, 112.

FIG. 2A illustrates a cross sectional profile of the fully assembled fence panel 200 taken along line 2A-2A shown in FIG. 1. FIG. 2B illustrates a portion of FIG. 2A at a larger scale. FIG. 2C illustrates a cross sectional profile of the fully assembled fence panel 200 taken along line 2C-2C shown in FIG. 1. FIG. 2D illustrates a portion of FIG. 2C at a larger scale. As illustrated in FIG. 2D, the fence boards 222 can have a first end including a key 274 and a second end including a keyway 276 complementary to the key 274. When the interior sub-panel assemblies 210 are assembled, the keys 274 of the fence boards 222 can be engaged with corresponding keyways 276 of adjacent fence boards 222. Thus, the fence boards 222 of an interior sub-panel assembly 210 can be interlocked with one another. In other instances, the fence boards 222 may lack the aforementioned keys 274 and keyways 276 and may have flat or blunt ends that may abut each other or may be spaced apart.

Any paired key and keyway that are complementary to one another such that they can fit together and engage with one another can allow the key to fit snugly or with some pre-selected clearance, or be received, within the corresponding keyway. The keys and keyways described herein are interlocking features that can assist in joining the various fence panel components together. The keys and keyways described herein can in some embodiments be tongues and grooves or tenons and mortises, and they can include surfaces that can interlock with one another. The keys and keyways described herein can have the same, similar, or different shapes as one another. The components of fence panel 200 are described as having keys and keyways in certain locations, though the locations can be modified as desired. In one simple modification, the locations of any keyway and its corresponding key(s) can be reversed. In some cases, the keys and keyways described herein can be referred to as first and second male-female mating features, where a first male-female mating feature can be a key and a complementary second male-female mating feature can be a complementary keyway, or a first male-female mating feature can be a keyway and a complementary second male-female mating feature can be a complementary key.

In some embodiments, many of the keys described herein can have the same structure, or matching profiles, as one another, such that the keys are standardized and interchangeable with one another. Similarly, many of the keyways described herein can have the same structure, or matching profiles, as one another, such that the keyways are standardized and interchangeable with one another. In such embodiments, manufacturing costs can be reduced and various components can be interchanged and re-arranged as desired. In some cases, the keys and keyways described herein can include recesses for receiving the heads of screws, nails, or other fasteners, and can include gap regions or other features for receiving glue or other adhesives, thereby allowing efficient installation and minimal seepage and expansion of the various components, such as seepage of an adhesive outside of a keyway.

FIGS. 3A through 3L illustrate one possible method of assembling a fence panel such as fence panel 200 via a top-down methodology. In the method illustrated in FIGS. 3A through 3L, the various components can be coupled or joined to one another in various ways, such as by using mechanical fasteners such as nails, screws, or bolts, or by using adhesives such as glue, such as glue rated for outdoor use, moisture activated PUR, epoxy, etc. Two components can be directly coupled or joined to one another, such that they are in direct contact, or can be indirectly coupled to one another, such that one or more other components are located between the two components. The top-down methodology illustrated in FIGS. 3A through 3L can be advantageous at least because it allows the user to obtain a relatively tight fit of the components at the top of the fence panel 200.

Figure 3A:
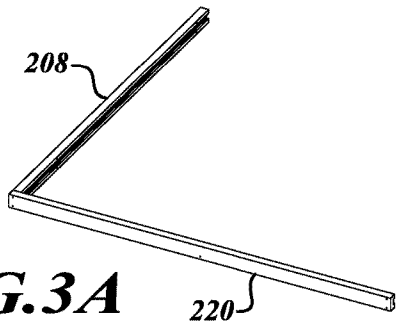
FIGS. 3A-3L illustrate one embodiment of a method of assembling a fence panel according to a top-down assembly methodology.
Figure 3B:
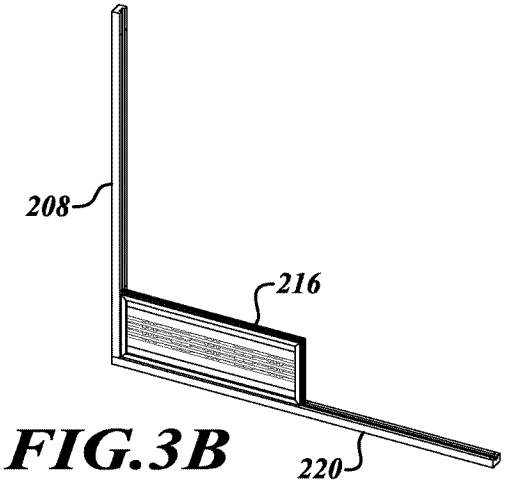

In FIG. 3A, the second side element or post 208 can be coupled to the top rail 220 to form a partially assembled fence panel, illustrated lying on the ground in FIG. 3A. For example, the key 208B can be engaged with the keyway 220A, and screws can be used to secure the second side element or post 208 to the top rail 220. In FIG. 3B, the partially assembled fence panel can be stood upright and the second lattice component 216 can be coupled to the top rail 220 and the second side element or post 208. For example, the key 256A can be engaged with the keyway 220A and the key 254A can be engaged with the keyway 208A.

Figure 3C:
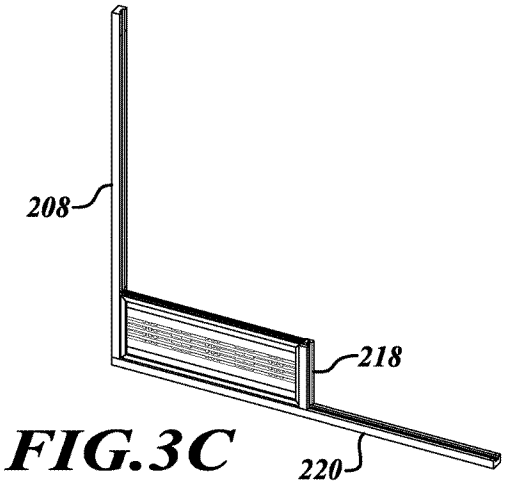
Figure 3D:
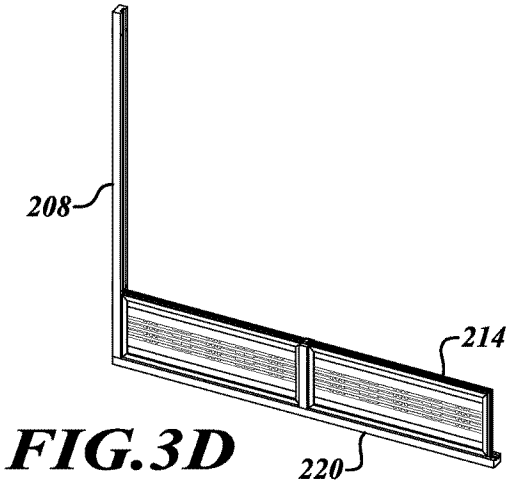

In FIG. 3C, the divider post 218 can be coupled to the top rail 220 and to the second lattice component 216. For example, the key 218C can be engaged with the keyway 220A, the key 252A can be engaged with the keyway 218B, and screws can be used to secure the divider post 218 to the top rail 220. In FIG. 3D, the first lattice component 214 can be coupled to the top rail 220 and to the divider post 218. For example, the key 246A can be engaged with the keyway 218A and the key 248A can be engaged with the keyway 220A. In FIG. 3E, the center rail 212 can be coupled to the second side element or post 208, the second lattice component 216, the divider post 218, and the first lattice component 214. For example, the key 212D can be engaged with the keyway 208A, the keys 258A, 218D, 250A can be engaged with the keyway 212B, and screws can be used to secure the center rail 212 to the divider post 218 and to the second side element or post 208.

Figure 3F:
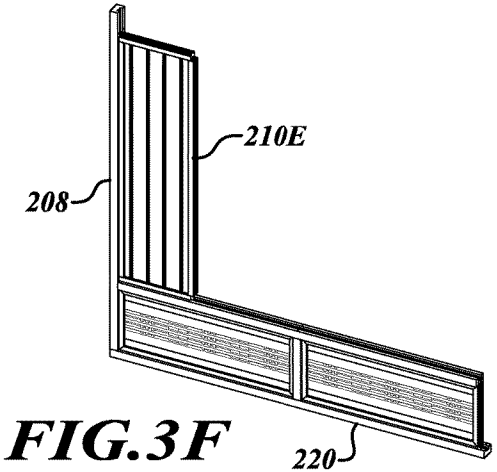
Figure 3H:
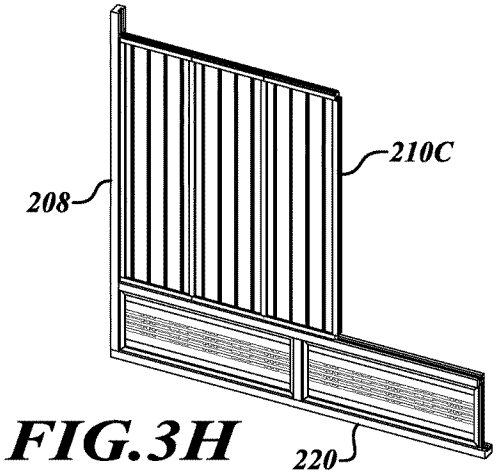
Figure 3E:
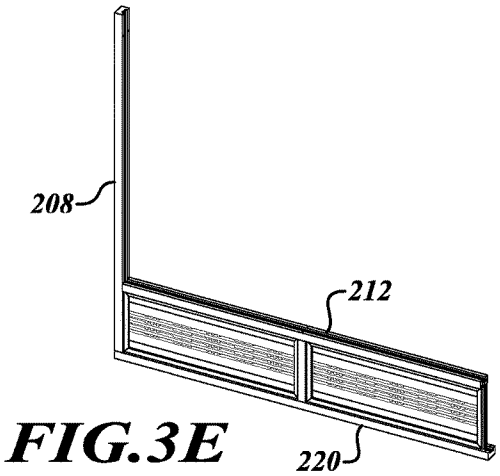
Figure 3G:
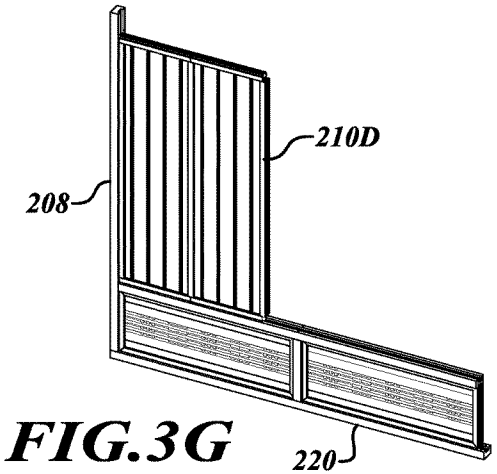
Figure 3J:
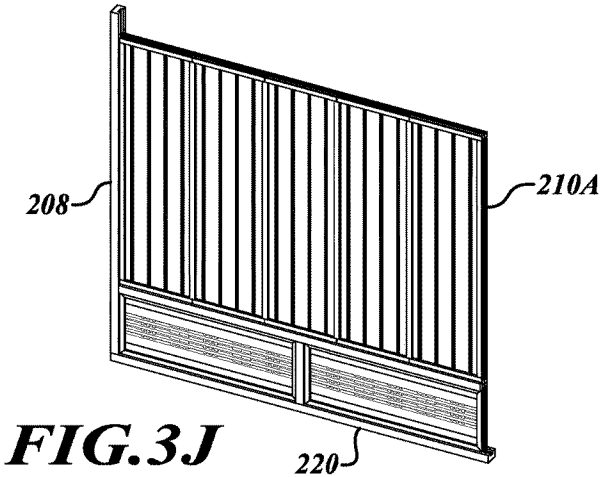
Figure 3L:
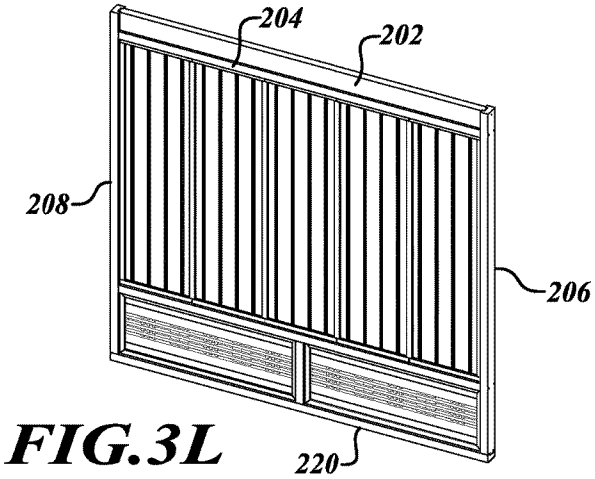
Figure 3I:
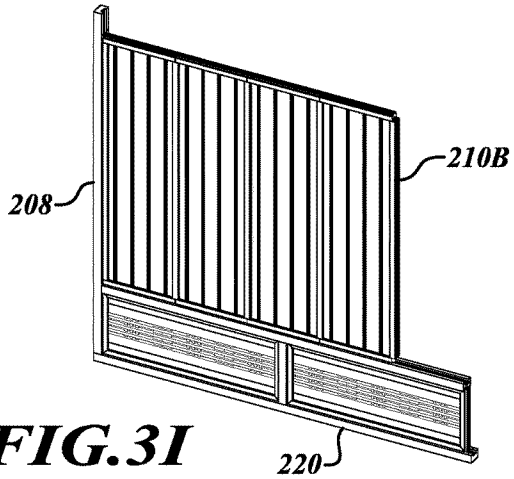

In FIG. 3F, the second end interior sub-panel assembly 210E can be coupled to the second side element or post 208 and to the center rail 212. For example, the key 242A can be engaged with the keyway 208A and the key 238A can be engaged with the keyway 212A. In FIG. 3G, the central interior sub-panel assembly 210D can be coupled to the second end interior sub-panel assembly 210E and to the center rail 212. For example, a fence board 222 of the assembly 210D can be engaged with the keyway 236A and the key 232A of the assembly 210D can be engaged with the keyway 212A. In FIG. 3H, the central interior sub-panel assembly 210C can be coupled to the central interior sub-panel assembly 210D and to the center rail 212. For example, a fence board 222 of the assembly 210C can be engaged with the keyway 230A of the assembly 210D and the key 232A of the assembly 210C can be engaged with the keyway 212A. In FIG. 3I, the central interior sub-panel assembly 210B can be coupled to the central interior sub-panel assembly 210C and to the center rail 212. For example, a fence board 222 of the assembly 2106 can be engaged with the keyway 230A of the assembly 210C and the key 232A of the assembly 2106 can be engaged with the keyway 212A. In FIG. 3J, the first end interior sub-panel assembly 210A can be coupled to the central interior sub-panel assembly 2106 and to the center rail 212. For example, a fence board 222 of the assembly 210A can be engaged with the keyway 230A of the assembly 2106 and the key 226A of the assembly 210A can be engaged with the keyway 212A.

Figure 3K:
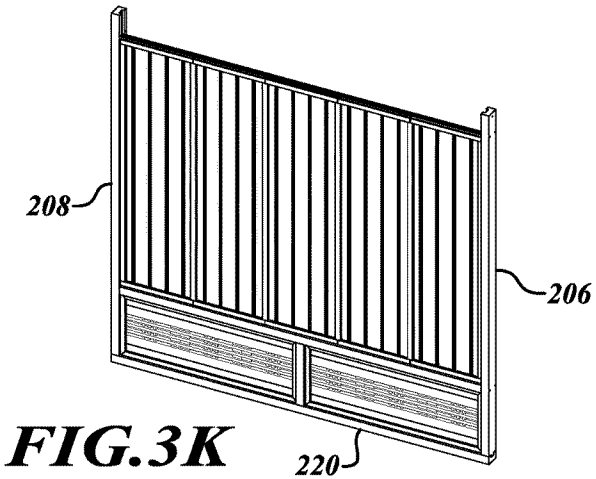

In FIG. 3K, the first side element or post 206 can be coupled to the top rail 220, the first lattice component 214, the center rail 212, and the first end interior sub-panel assembly 210A. For example, the key 206B can be engaged with the keyway 220A, the keys 244A, 212C, 226C, 224A, and 228C can be engaged with the keyway 206A, and screws can be used to secure the first side element or post 206 to the top rail 220 and to the center rail 212. In FIG. 3L, the base element 202 can be coupled to the bottom rail 204 (e.g., using screws) to form the elongate bottom crossbar, and the elongate bottom crossbar can be coupled to the first side element or post 206, the second side element or post 208, and the sub-panel assemblies 210A-210E. For example, the keys 202A and 204A can be engaged with the keyway 206A, the keys 202B and 204B can be engaged with the keyway 208A, the keys 228A, 234A, and 240A of the sub-panel assemblies 210A-210E can be engaged with the keyway 204C, and screws can be used to secure the elongate bottom crossbar to the second side element or post 208 and to the first side element or post 206.

In the method illustrated in FIGS. 3A to 3L, each of the sub-panel assemblies 210 and each of the lattice components 214, 216 can be pre-assembled. That is, the components of each sub-panel assembly 210 and each lattice component 214, 216 can be secured to one another prior to packaging the sub-panel assembly for storage or shipment. In alternative embodiments, however, these components can come disassembled instead of pre-assembled. The elongate bottom crossbar may be pre-assembled or coupled together prior to receipt by an end-user. Although a two-piece bottom crossbar is shown, a single, unitary bottom crossbar having the same or different cross-sectional profile may be provided in some embodiments.

In the method illustrated in FIGS. 3A to 3L, the base element 202, bottom rail 204, top rail 220, second side element or post 208, divider post 218, first side element or post 206, lattice components 214, 216, center rail 212, and sub-panel assemblies 210A-210E can be disconnected from one another when packaged for storage and shipment. That is, no mechanical fasteners or adhesives can fasten or affix these components to one another when they are packaged for storage or shipment.

As described above, screws or other fasteners can be used to secure (i.e., fasten or directly couple) the second side element or post 208, top rail 220, divider post 218, center rail 212, first side element or post 206, base element 202, and the bottom rail 204 to one another. In some embodiments, the pilot holes 260 shown in FIG. 2 or indentations or depressions indicating fastener locations can be provided in these components prior to packaging for storage and assembly to facilitate the use of screws or other fasteners in this way during assembly of the fence panel 200. In some embodiments, screws (or alternate fasteners) can be the only mechanism fastening the components of the fence panel 200 to one another. That is, the sub-panel assemblies 210 and the lattice components 214, 216 can be secured to the other components of the fence panel 200 only by way of the keys and keyways of the components of the fence panel 200. That is, they can be held captive within the completely assembled fence panel 200 by the keys and keyways of the various components of the fence panel 200. Thus, the fence panel 200 can be assembled, for example at an installation location, using a minimal number of mechanical fasteners and no adhesives, minimizing material costs and time required to assemble the fence panel 200.

Figure 4B:
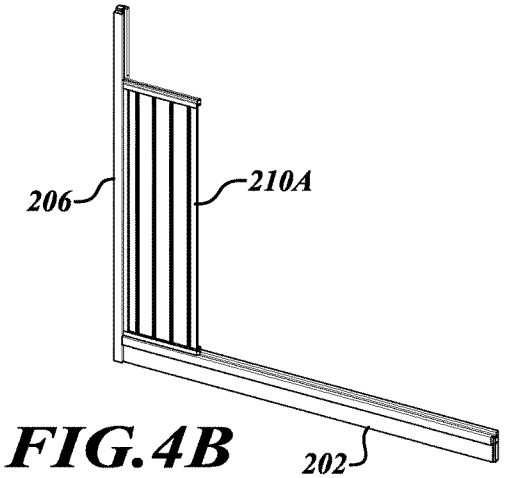
FIGS. 4A-4L illustrate another embodiment of a method of assembling a fence panel according to a bottom-up methodology.
Figure 4D:
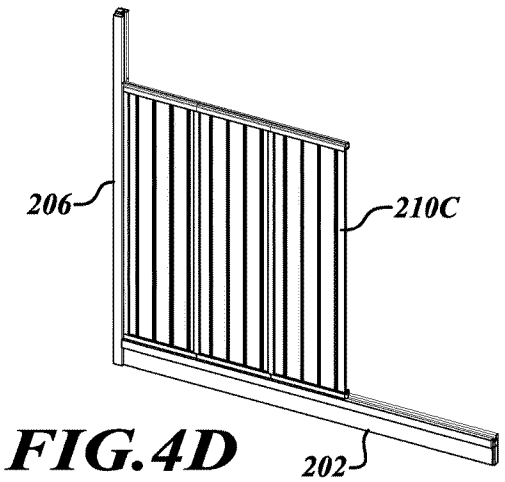
Figure 4A:
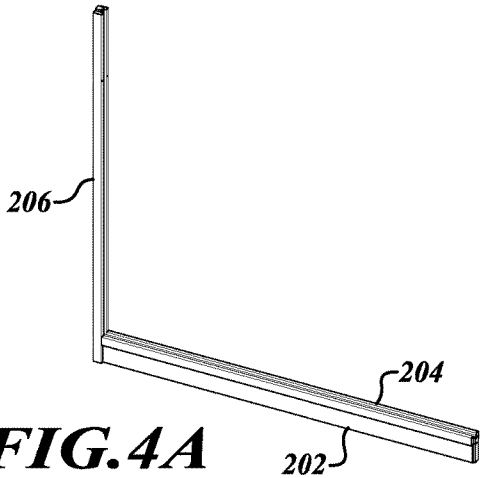

FIGS. 4A to 4L illustrate another possible method of assembling a fence panel such as fence panel 200 via a bottom-up methodology. In the method illustrated in FIGS. 4A to 4L, the various components can be coupled to one another in various ways, such as by using mechanical fasteners such as nails, screws, or bolts, or by using adhesives such as glue, epoxy, etc. In FIG. 4A, the base element 202 can be coupled to the bottom rail 204 (e.g., using screws) to form the elongate bottom crossbar, and the first side element or post 206 can be coupled to the elongate bottom crossbar to form a partially assembled fence panel. For example, the keys 202A, 204A can be engaged with the keyway 206A, and screws can be used to secure the first side element or post 206 to the elongate bottom crossbar.

Figure 4C:
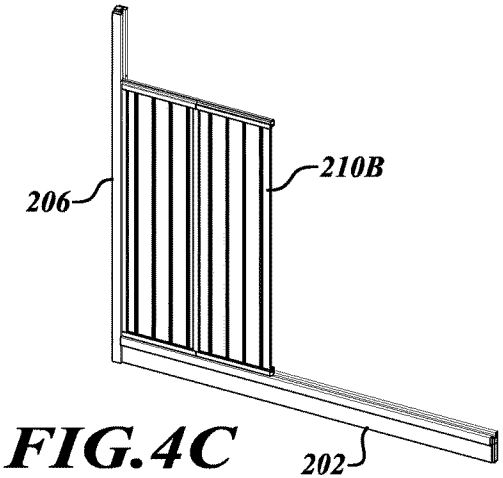
Figure 4F:
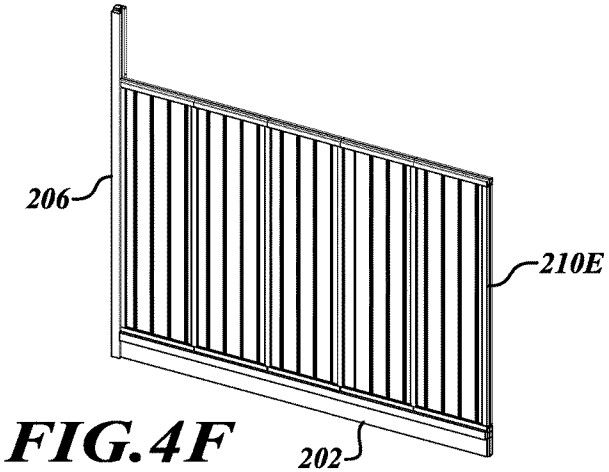
Figure 4H:
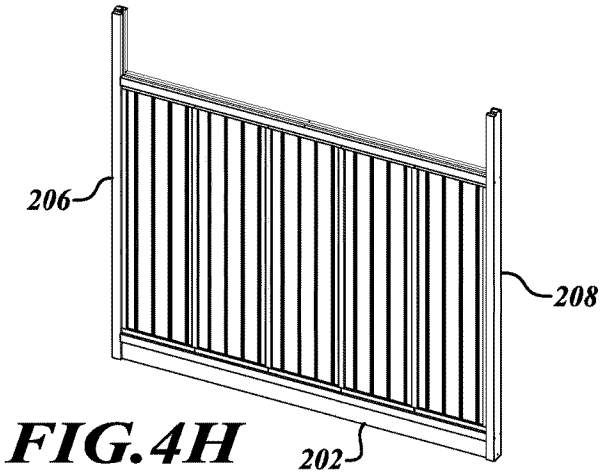
Figure 4E:
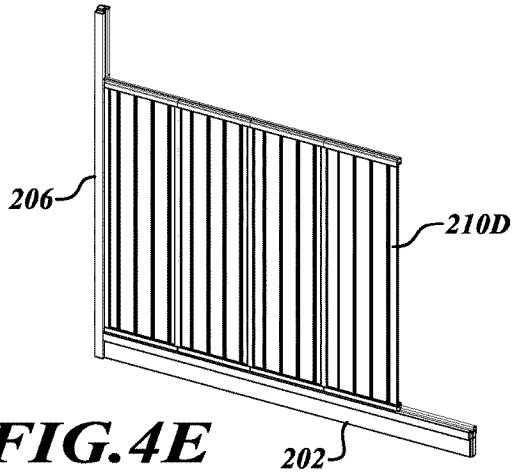

In FIG. 4B, the first end interior sub-panel assembly 210A can be coupled to the first side element or post 206 and to the elongate bottom crossbar. For example, the key 224A can be engaged with the keyway 206A and the key 228A can be engaged with the keyway 204C. In FIG. 4C, the central interior sub-panel assembly 210B can be coupled to the first end interior sub-panel assembly 210A and to the elongate bottom crossbar. For example, a fence board 222 of the assembly 210A can be engaged with the keyway 230A and the key 234A of the assembly 210B can be engaged with the keyway 204C. In FIG. 4D, the central interior sub-panel assembly 210C can be coupled to the central interior sub-panel assembly 210B and to the elongate bottom crossbar. For example, a fence board 222 of the assembly 210B can be engaged with the keyway 230A of the assembly 210C and the key 234A of the assembly 210C can be engaged with the keyway 204C. In FIG. 4E, the central interior sub-panel assembly 210D can be coupled to the central interior sub-panel assembly 210C and to the elongate bottom crossbar. For example, a fence board 222 of the assembly 210C can be engaged with the keyway 230A of the assembly 210D and the key 234A of the assembly 210D can be engaged with the keyway 204C. In FIG. 4F, the second end interior sub-panel assembly 210E can be coupled to the central interior sub-panel assembly 210D and to elongate bottom crossbar. For example, a fence board 222 of the assembly 210D can be engaged with the keyway 236A of the assembly 210E and the key 240A of the assembly 210E can be engaged with the keyway 204C.

Figure 4G:
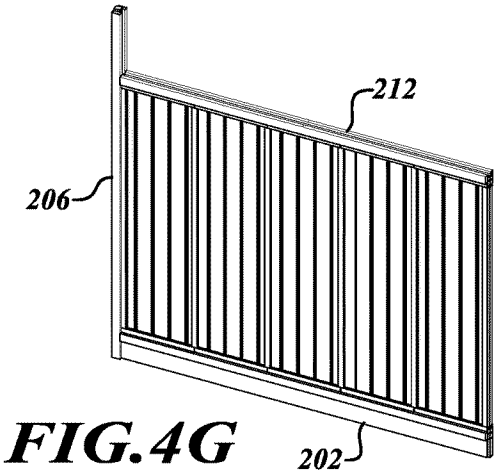

In FIG. 4G, the center rail 212 can be coupled to the first side element or post 206 and to the sub-panel assemblies 210A-210E. For example, the key 212C can be engaged with the keyway 206A, the keys 226A, 232A, and 238A of the assemblies 210A-210E can be engaged with the keyway 212A, and screws can be used to secure the first side element or post 206 to the center rail 212. In FIG. 4H, the second side element or post 208 can be coupled to the elongate bottom crossbar, the second end interior sub-panel assembly 210E, and to the center rail 212. For example, the keys 202B, 204B, 242A, and 212D can be engaged with the keyway 208A and screws can be used to secure the second side element or post 208 to the elongate bottom crossbar and to the center rail 212. In FIG. 4I, the first lattice component 214 can be coupled to the center rail 212 and to the first side element or post 206. For example, the key 244A can be engaged with the keyway 206A and the key 250A can be engaged with the keyway 212B.

Figure 4J:
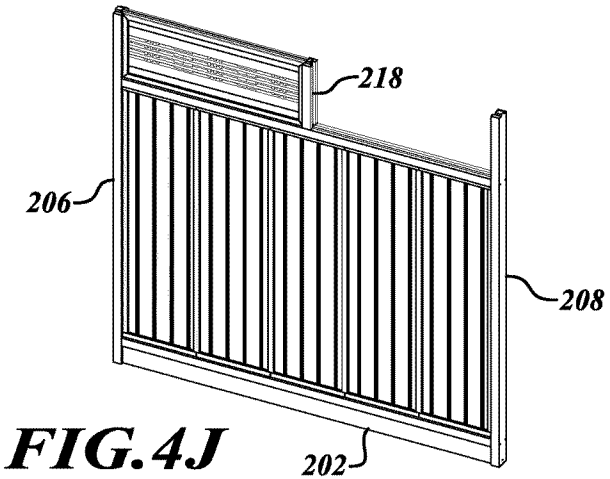
Figure 4L:
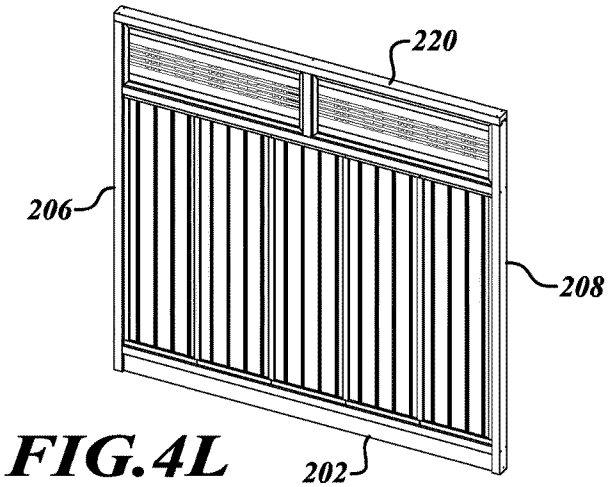
Figure 4I:
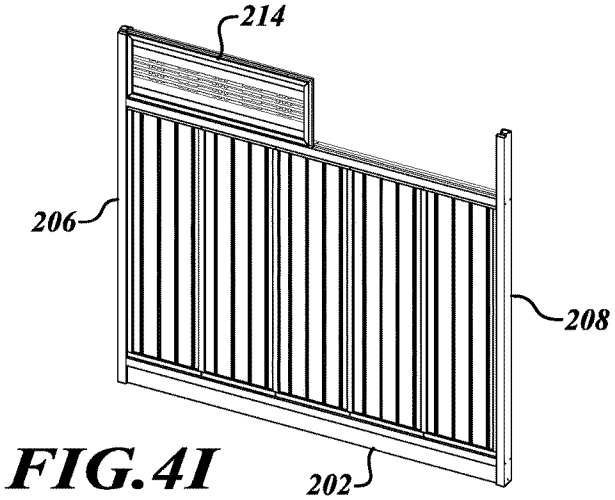
Figure 4K:
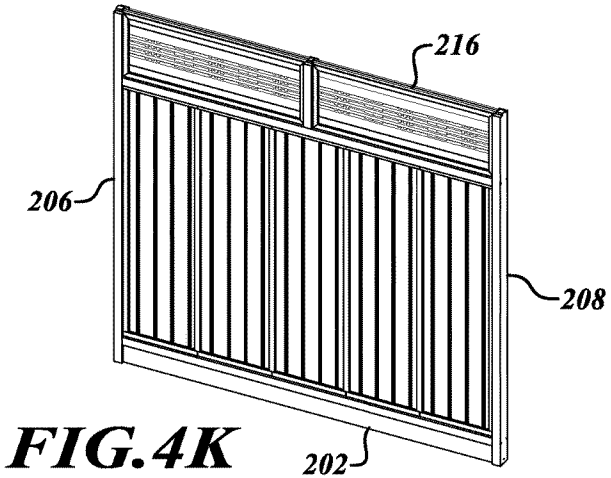

In FIG. 4J, the divider post 218 can be coupled to the center rail 212 and to the first lattice component 214. For example, the key 246A can be engaged with the keyway 218A, the key 218D can be engaged with the keyway 212B, and screws can be used to secure the divider post 218 to the center rail 212. In FIG. 4K, the second lattice component 216 can be coupled to the center rail 212 and to the divider post 218. For example, the key 228A can be engaged with the keyway 212B and the key 252A can be engaged with the keyway 218B. In FIG. 4L, the top rail 220 can be coupled to the first side element or post 206, the first lattice component 214, the divider post 218, the second lattice component 216, and the second side element or post 208. For example, the keys 206B, 248A, 218C, 256A, and 208B can be engaged with the keyway 220A and screws can be used to secure the top rail 220 to the first side element or post 206, divider post 218, and second side element or post 208.

In the method illustrated in FIGS. 4A to 4L, each of the sub-panel assemblies 210 and each of the lattice components 214, 216, can be pre-assembled. That is, the components of each sub-panel assembly 210 and each lattice component 214, 216, can be secured to one another prior to packaging the sub-panel assembly for storage or shipment. In alternative embodiments, however, these components can come disassembled instead of pre-assembled. The elongate bottom crossbar may be pre-assembled or coupled together prior to receipt by an end-user. Although a two-piece bottom crossbar is shown, a single, unitary bottom crossbar having the same or different cross-sectional profile may be provided in some embodiments.

In the method illustrated in FIGS. 4A to 4L, the base element 202, bottom rail 204, top rail 220, second side element or post 208, divider post 218, first side element or post 206, lattice components 214, 216, center rail 212, and sub-panel assemblies 210A-210E, can be disconnected from one another when packaged for storage and shipment. That is, no mechanical fasteners or adhesives can fasten or affix these components to one another when they are packaged for storage or shipment.

Figure 5:
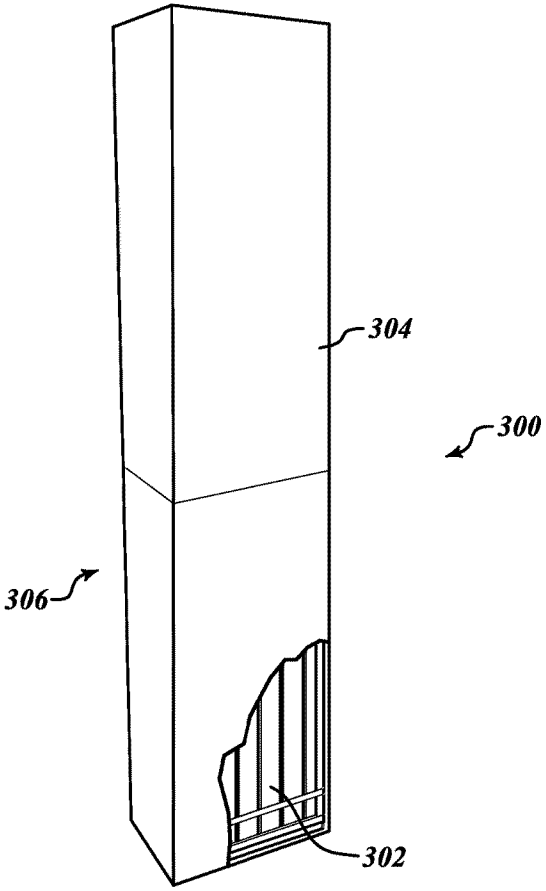
FIG. 5 illustrates a packaged fence panel kit, according to one example embodiment, which includes all components for constructing a fence panel in a single packaged arrangement.

The components of a fence panel such as fence panel 200 can be referred to collectively as a fence panel kit. A fence panel kit can be packaged in various ways for storage and transportation from a manufacturing or packaging location to an installation location or other location, such as, for example, home improvement and hardware stores for sale to individual consumers, contractors, fence builders or others. FIG. 5 illustrates that in some embodiments, a fence panel kit 300 can include a plurality of fence panel components 302 packaged within external packaging 304 such as cardboard or plastic to form a single packaged arrangement 306 of fence panel components 302. In some embodiments, the fence panel components 302 include the base element 202, bottom rail 204, first side element or post 206, second side element or post 208, sub-panel assemblies 210, center rail 212, lattice components 214, 216, divider post 218, and top rail 220, and each of these components 302 can be disconnected from one another in the single packaged arrangement 306 of the kit 300. Fasteners may also be included such that an entirety of a fence panel can be constructed or erected from the single packaged arrangement 306.

Figures 5A, 5B, 5C, 5D, 5E, 5F:
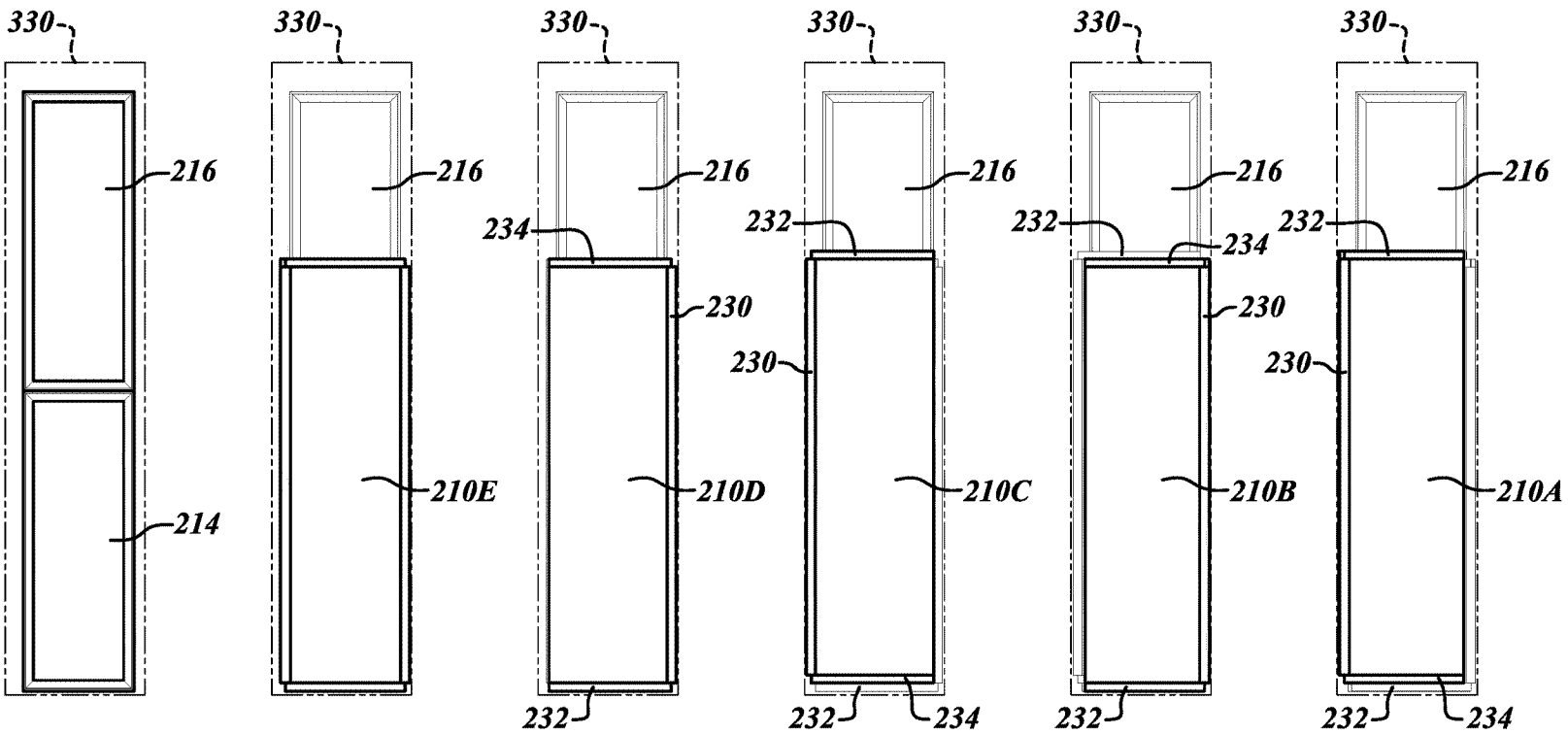
FIGS. 5A-5F illustrate one embodiment of stacking fence panel components to facilitate storage and transport of all components for constructing a fence panel in a single packaged arrangement.

FIGS. 5A through 5F illustrate one method of efficiently stacking the fence panel components 302 for packaging within the external packaging 304. In particular, FIG. 5A illustrates that many of the components, including the base element 202, bottom rail 204, first side element or post 206, second side element or post 208, center rail 212, divider post 218, and top rail 220 can be positioned in a first, bottom layer 330 with these components generally aligned longitudinally in a side-by-side manner, and the first and second lattice components 214, 216 can be positioned in a second layer stacked on top of the first layer. FIG. 5B illustrates that the second end interior sub-panel assembly 210E can be positioned in a third layer stacked on top of the second layer.

FIG. 5C illustrates that the central interior sub-panel assembly 210D can be positioned in a fourth layer stacked on top of the third layer, such that the first end perimeter component 230 of the sub-panel assembly 210D is positioned at a first side of the stack of the components 302. FIG. 5D illustrates that the central interior sub-panel assembly 210C can be positioned in a fifth layer stacked on top of the fourth layer, such that the first end perimeter component 230 of the sub-panel assembly 210C is positioned at a second side, opposite to the first side, of the stack of the components 302, such that the bottom perimeter component 234 of the assembly 210C is adjacent to and offset from the top perimeter component 232 of the assembly 210D, and such that the top perimeter component 232 of the assembly 210C is adjacent to and offset from the bottom perimeter component 234 of the assembly 210D.

FIG. 5E illustrates that the central interior sub-panel assembly 210B can be positioned in a sixth layer stacked on top of the fifth layer, such that the first end perimeter component 230 of the sub-panel assembly 210B is positioned at the first side of the stack of the components 302, such that the bottom perimeter component 234 of the assembly 2106 is adjacent to and offset from the top perimeter component 232 of the assembly 210C, and such that the top perimeter component 232 of the assembly 2106 is adjacent to and offset from the bottom perimeter component 234 of the assembly 210C. FIG. 5F illustrates that the first end interior sub-panel assembly 210A can be positioned in a seventh layer stacked on top of the sixth layer, such that the first end perimeter component 224 of the sub-panel assembly 210A is positioned at the second side of the stack of the components 302, such that the bottom perimeter component 228 of the assembly 210A is adjacent to and offset from the top perimeter component 232 of the assembly 2106, and such that the top perimeter component 226 of the assembly 210A is adjacent to and offset from the bottom perimeter component 234 of the assembly 210B.

Thus, the fence panel components 302 can be stacked in a nested configuration with each assembly 210 interlaid with the adjacent assemblies 210 such that the orientations of the assemblies 210 alternate within the stack of the components 302. This nested stacking configuration can be particularly efficient, and can allow the stack of fence panel components 302 for constructing a fence panel having overall dimensions of about 72 inches wide by 72 inches tall to have a height of about 9 inches or less than 10 inches, a width of about 16 inches or less than 17 inches, and a length of about 72 inches or less than 73 inches, and be packaged in a single box or external packaging 304 having a height of about 9 inches or less than 10 inches, a width of about 16 inches or less than 17 inches (e.g., 16.25 inches), and a length of about 72 inches or less than or equal to 73 inches.

Figure 6:
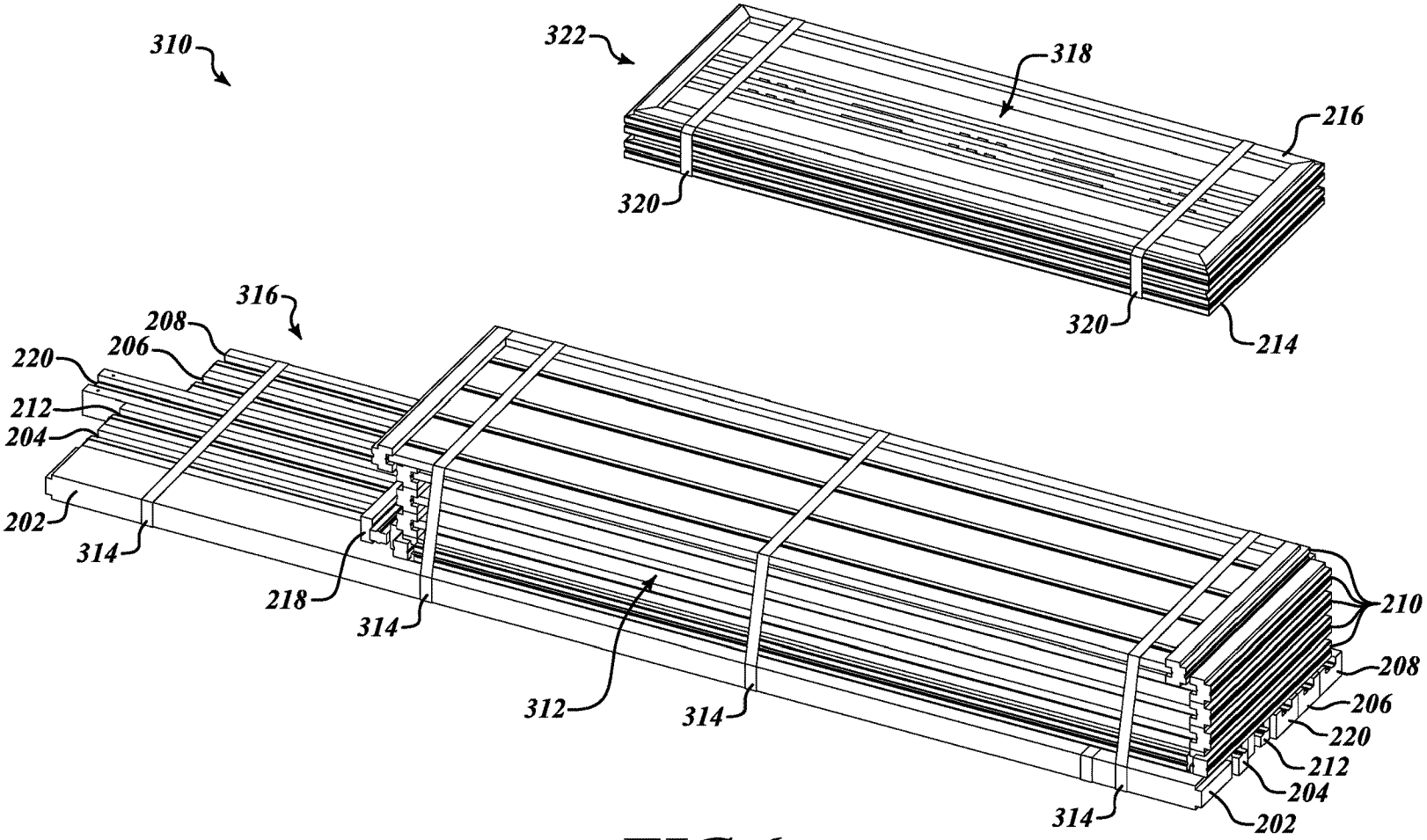
FIG. 6 illustrates a packaged fence panel kit, according to another example embodiment, which includes all components for constructing a fence panel in a two packaged arrangements including a base panel kit and a lattice kit.

FIG. 6 illustrates that in other embodiments, a fence panel kit 310 can include a plurality of fence panel components 312 packaged within external packaging 314 such as metallic or plastic bands wrapped around the components 312 to hold them against one another to form a first packaged arrangement 316 of fence panel components 312. In some embodiments, the fence panel components 312 include the components of a main body of a fence panel, that is, the base element 202, bottom rail 204, first side element or post 206, second side element or post 208, sub-panel assemblies 210, center rail 212, divider post 218, and the top rail 220, as well as the fasteners such as screws that allow the components to be fastened to one another, and each of these components 312 can be disconnected from one another in the first packaged arrangement 316 of the kit 310. The first packaged arrangement 316 can be referred to as a main body packaged arrangement 316.

Figure 7:
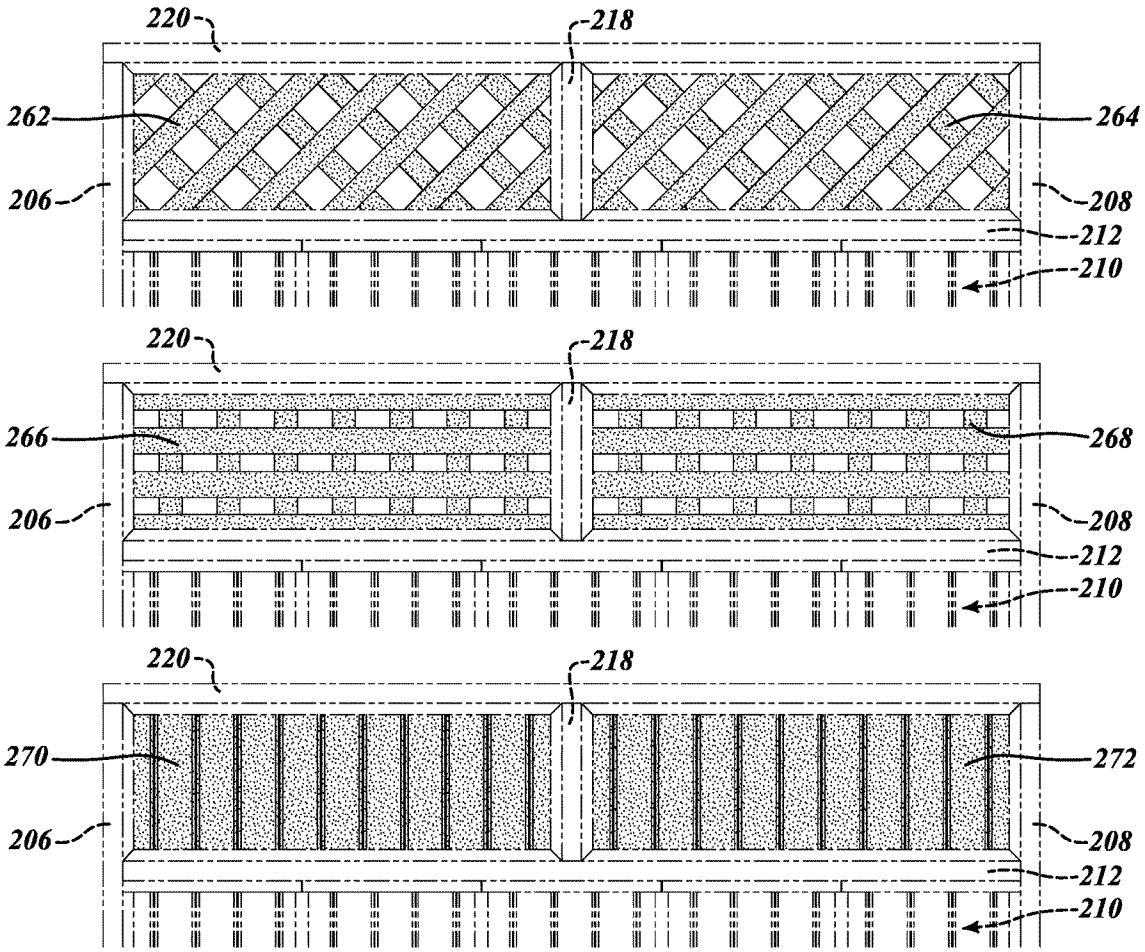
FIG. 7 illustrates different example embodiments of fence panel latticework patterns which may be provided in connection with the fence panels.

The fence panel kit 310 can also include a plurality of fence panel components 318 packaged within external packaging 320 such as metallic or plastic bands wrapped around the components 318 to hold them against one another to form a second packaged arrangement 322 of fence panel components 318. In some embodiments, the fence panel components 318 include the first and second lattice components 214, 216, and each of these components 318 can be disconnected from one another in the second packaged arrangement 322 of the kit 310. The second packaged arrangement 322 can be referred to as a lattice packaged arrangement. In such embodiments, a consumer (e.g., individual homeowner, contractor, fence builder, etc.) can purchase a main body packaged arrangement, and can select a lattice packaged arrangement from a plurality of different lattice packaged arrangements based on their preference for latticework patterns. Additional lattice components having different latticework patterns, such as copper lattice, solid slate filling in the lattice area, stamped tin lattice components, and lattice components having engraved figures such as stars, fish, etc. can also be made available for purchase by the consumer. Some examples of alternate lattice components are shown in FIG. 7.

FIG. 6 illustrates a first configuration of the main body packaged arrangement 316 that includes a stack of the sub-panel assemblies 210 stacked on top of the base element 202, bottom rail 204, first side element or post 206, second side element or post 208, center rail 212, and top rail 220. The divider post 218 can be adjacent to the stack of sub-panel assemblies 210 on top of the rest of the components 312. In a second possible configuration, however, at least two sub-panel assemblies 210 are stacked on one another in a first stack, at least two sub-panel assemblies 210 are stacked on one another in a second stack, the first stack and the second stack are longitudinally adjacent to one another, and the first stack and the second stack are positioned on top of the rest of the components of the main body packaged arrangement 316. In such a configuration, the rest of the components of the main body packaged arrangement 316 span across and hold the first and second stacks together.

Both of these configurations of the main body packaged arrangement are compact and space-efficient. In particular, a main body packaged arrangement 316 having the second configuration can have overall dimensions of about 99" by about 16" by about 6", and can weigh about 65 lbs. or less. The lattice packaged arrangement can have overall dimensions of about 47" by about 13" by about 3", and can weigh about 13 lbs. or less. A complete fence panel having a height of about 69" and a length of about 72" can be assembled from these two packaged arrangements of fence panel components.

As explained above, the lattice components 214, 216 each have a first latticework pattern. FIG. 7 illustrates that fence panels can include various other lattice components that have various other latticework patterns. The components of the fence panels described herein other than the lattice components, e.g., the base element 202, bottom rail 204, first side element or post 206, second side element or post 208, sub-panel assemblies 210, center rail 212, divider post 218, and top rail 220, can be referred to collectively as a main body of the fence panel when assembled, and various different lattice components can be provided and can be interchangeably combined with the main body to form a fully assembled fence panel.

For example, FIG. 7 illustrates that some lattice components 262, 264 can have a generally diagonal latticework pattern that is different from the latticework pattern shown in FIG. 1 and can be combined with a fence panel main body to form a fully assembled fence panel. As another example, FIG. 7 illustrates that some lattice components 266, 268 can have a generally horizontal and vertical latticework pattern that is different from the aforementioned latticework patterns and can be combined with a fence panel main body to form a fully assembled fence panel. As yet another example, FIG. 7 illustrates that lattice components 270, 272 can have a solid latticework pattern that is still yet different from the other illustrated latticework patterns and can be combined with a fence panel main body to form a fully assembled fence panel.

FIG. 7 illustrates that individual components of the fence panels described herein (e.g., the lattice components) can be interchanged or replaced with alternative components as desired, without the need to fabricate or obtain any additional components. FIG. 7 illustrates that the lattice components are interchangeable or replaceable, although all of the components of the fence panels described herein are similarly interchangeable or replaceable. For example, the sub-panel assemblies 210 can be replaced with sub-panel assemblies of another style or design. In some cases, the sub-panel assemblies 210 can be replaced with interior lattice elements having a latticework pattern matching the latticework pattern of one of the lattice elements described herein.

In some embodiments, any of the fence panels described herein can include a cable or wire such as a ⅛" galvanized wire rope coupled to and spanning between the first side post and the second side post to provide tension between the side posts, such as to add lateral wind load stability for longer fence panels such as 96" long fence panels. In some cases, the cable can be coupled to the first and second side posts using threaded bolts, which can be turned to adjust the tension in the cable. In some cases, additional coupling elements such as clips can be used to structurally tie the cable to an interior portion of the fence panel to reduce frictional wear of the fence panel caused by motion of the cable. Such an embodiment can be used to provide additional wind strength if desired in high wind load areas.

Any of the fence panel components described herein can be fabricated from any suitable material or materials, such as various wood materials, plastic materials, vinyl, or metal materials. The fence panels and fence panel components described herein can have any suitable dimensions. The fence panels described herein can have any number of lattice components and any number of interior sub-panel assemblies. For example, a fence panel can have two lattice components and five interior sub-panel assemblies. In other embodiments, a fence panel can have 1, 3, 4, 5, 6, or more lattice components, and the fence panel can have 1, 2, 3, 4, 6, 7, 8, 9, 10, or more interior sub-panel assemblies.

Moreover, the various embodiments described above can be combined to provide further embodiments. U.S. provisional patent application No. 62/037,544 is incorporated herein by reference, in its entirety. Aspects of the embodiments described herein can be combined with any additional aspects shown or described in the '544 application to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method of constructing a fence panel, the method comprising:

assembling a fence panel from one or more packaged arrangements of fence panel components, the fence panel components of the fence panel including a plurality of interior sub-panel assemblies, a first side element, a second side element, a center rail, a bottom rail, a top rail, a lattice divider, and a plurality of lattice components, wherein the plurality of interior sub-panel assemblies include a first interior sub-panel assembly including a first plurality of fence boards and a second interior sub-panel assembly including a second plurality of fence boards, wherein the first interior sub-panel assembly includes a top perimeter component engaged with top ends of the first plurality of fence boards and a bottom perimeter component engaged with bottom ends of the first plurality of fence boards, wherein the second interior sub-panel assembly includes an end perimeter component engaged in direct contact with a first end of the second plurality of fence boards, and wherein the top perimeter component and the bottom perimeter component of the first sub-panel assembly each extend a distance beyond all of the other components of the first sub-panel assembly to accommodate the end perimeter component of the second sub-panel assembly between the top perimeter component and the bottom perimeter component when assembled, and the assembly of the fence panel comprising:

joining the plurality of interior sub-panel assemblies together laterally between the first and second side elements and longitudinally between the center rail and the bottom rail to form a panel main body; and joining the plurality of lattice components to the panel main body.

2. The method of claim 1 wherein joining the plurality of interior sub-panel assemblies together laterally between the first and second side elements and longitudinally between the center rail and the bottom rail to form the panel main body includes fitting a male-female mating feature of the first interior sub-panel assembly into a male-female mating feature of the second interior sub-panel assembly.

3. The method of claim 1 wherein joining the plurality of interior sub-panel assemblies together laterally between the first and second side elements and longitudinally between the center rail and the bottom rail to form a panel main body comprises:

coupling a first end interior sub-panel assembly to the first side element and to the bottom rail;

coupling one or more intermediate interior sub-panel assemblies to the first end interior sub-panel assembly and the bottom rail;

coupling a second end interior sub-panel assembly to the one or more intermediate interior sub-panel assemblies and to the bottom rail; and coupling the second side element to the second end interior sub-panel assembly.

4. The method of claim 3, wherein joining the plurality of lattice components to the panel main body comprises:

coupling a first lattice structure to the first side element;

coupling a second lattice structure to the second side element; and coupling the lattice divider between the first lattice structure and the second lattice structure.

5. The method of claim 3 wherein coupling the first end interior sub-panel assembly to the first side element and to the bottom rail comprises coupling a first end male-female mating feature of the first end interior sub-panel assembly to a male-female mating feature of the first side element and a bottom male-female mating feature of the first end interior sub-panel assembly to a male-female mating feature of the bottom rail.

6. The method of claim 3 wherein coupling the one or more intermediate interior sub-panel assemblies to the first end interior sub-panel assembly and the bottom rail comprises coupling a plurality of interior sub-panel assemblies together in a side-by-side arrangement.

7. The method of claim 6 wherein coupling the second end interior sub-panel assembly to the one or more intermediate interior sub-panel assemblies and to the bottom rail comprises coupling a first end male-female mating feature of the second end interior sub-panel assembly to a male-female mating feature of the one or more intermediate interior sub-panel assemblies and a bottom male-female mating feature of the second interior sub-panel assembly to a male-female mating feature of the bottom rail.

8. The method of claim 3 wherein coupling the second side element to the second end interior sub-panel assembly comprises coupling a male-female mating feature of the second end interior sub-panel assembly to a corresponding male-female mating feature of the second side element.

9. The method of claim 1 wherein joining the plurality of interior sub-panel assemblies and joining the plurality of lattice components includes:

joining the top rail to the first side element;

joining a first lattice component to the top rail and to the first side element;

joining the lattice divider to the top rail and to the first lattice component;

joining a second lattice component to the top rail and to the lattice divider;

joining the center rail to the first side element, the first lattice component, the lattice divider, and the second lattice component;

joining the first interior sub-panel assembly to the first side element and to the center rail;

joining the second interior sub-panel assembly to the center rail and indirectly to the first interior sub-panel assembly;

joining the second side element to the top rail, to the second lattice component, to the center rail, and to the second interior sub-panel assembly; and joining the bottom rail to the first interior sub-panel assembly, to the second interior sub-panel assembly, to the first side element, and to the second side element.

10. The method of claim 1 wherein joining the plurality of interior sub-panel assemblies and joining the plurality of lattice components includes:

joining the bottom rail to the first side element;

joining the first interior sub-panel assembly to the bottom rail and to the first side element;

joining the second interior sub-panel assembly to the bottom rail and indirectly to the first interior sub-panel assembly;

joining the center rail to the first side element, the first interior sub-panel assembly, and to the second interior sub-panel assembly;

joining the second side element to the bottom rail, to the second interior sub-panel assembly, and to the center rail;

joining a first lattice component to the first side element and to the center rail;

joining the lattice divider to the center rail and to the first lattice component;

joining a second lattice component to the lattice divider, to the center rail, and to the second side element; and joining the top rail to the first side element, to the first lattice component, to the lattice divider, to the second lattice component, and to the second side element.

* * * * *